US009366497B1

(12) United States Patent
Hout et al.

(10) Patent No.: US 9,366,497 B1
(45) Date of Patent: Jun. 14, 2016

(54) CROSSBOW LIMB POCKET WITH KEYED INTERCONNECTION

(71) Applicant: Hunter's Manufacturing Company, Inc., Suffield, OH (US)

(72) Inventors: Jacob A. Hout, Akron, OH (US); Richard L. Bednar, Munroe Falls, OH (US); Dean Mook, Suffield, OH (US)

(73) Assignee: Hunter's Manufacturing Co., Inc., Suffield, OH (US)

( * ) Notice: Subject to any disclaimer, the term of this patent is extended or adjusted under 35 U.S.C. 154(b) by 0 days.

(21) Appl. No.: 14/924,185

(22) Filed: Oct. 27, 2015

Related U.S. Application Data

(60) Provisional application No. 62/115,501, filed on Feb. 12, 2015.

(51) Int. Cl.
*F41B 5/12* (2006.01)
*F41B 5/14* (2006.01)
*F41B 5/00* (2006.01)

(52) U.S. Cl.
CPC ..... *F41B 5/123* (2013.01); *F41B 5/0026* (2013.01); *F41B 5/12* (2013.01); *F41B 5/1403* (2013.01)

(58) Field of Classification Search
CPC ..... F41B 5/12; F41B 5/14; F41B 5/123
USPC ..... 124/23.1, 25, 25.6, 86, 88
See application file for complete search history.

(56) References Cited

U.S. PATENT DOCUMENTS 3,821,946 A * 7/1974 Griggs ..... F41B 5/0026 124/23.1
5,429,106 A * 7/1995 Martin ..... F41B 5/0026 124/23.1
5,720,267 A * 2/1998 Walk ..... F41B 5/10 124/23.1
6,571,785 B1 * 6/2003 Choma ..... F41B 5/123 124/23.1
6,712,057 B2 * 3/2004 Andrews ..... F41B 5/0026 124/23.1
6,886,549 B2 * 5/2005 McPherson ..... F41B 5/0026 124/23.1
7,077,116 B1 * 7/2006 Darlington ..... F41B 5/10 124/23.1
7,334,575 B2 * 2/2008 McPherson ..... F41B 5/0026 124/23.1
7,584,750 B2 * 9/2009 Chang ..... F41B 5/12 124/23.1
7,891,348 B2 * 2/2011 Colley ..... F41B 5/105 124/25
8,069,847 B2 * 12/2011 Blosser ..... F41B 5/0026 124/23.1
8,453,635 B1 * 6/2013 McPherson ..... F41B 5/10 124/23.1
8,701,644 B2 * 4/2014 McPherson ..... F41B 5/10 124/23.1
8,851,056 B2 * 10/2014 Trpkovski ..... F41B 5/10 124/23.1
2009/0145411 A1 * 6/2009 Sims ..... F41B 5/10 124/25.6
2010/0263650 A1 * 10/2010 Dahl, II ..... F41B 5/10 124/25.6
2013/0192573 A1 * 8/2013 McPherson ..... F41B 5/1403 124/23.1
2013/0312724 A1 * 11/2013 Hudkins ..... F41B 5/123 124/25

* cited by examiner

*Primary Examiner* — Alexander Niconovich
(74) *Attorney, Agent, or Firm* — Emerson Thomson Bennett, LLC

(57) ABSTRACT

A crossbow limb pocket for use in mounting a bow limb to a crossbow may include an inner limb pocket component and an outer limb pocket component. One of the components may have at least one groove while the other has at least one key. The key may be received within the groove to prevent relative rotational movement of the components when the crossbow is operated.

20 Claims, 42 Drawing Sheets

CROSSBOW LIMB POCKET WITH KEYED INTERCONNECTION

I. BACKGROUND

A. Field of the Invention

This invention relates generally to the field of crossbows and, more specifically, to apparatuses and methods regarding the attachment of bow limbs to crossbow main beams.

B. Description of Related Art

Crossbows have been used for many years as a weapon for hunting, fishing, and for target shooting. In general, a crossbow includes a main beam, a bow assembly supported to the main beam and a trigger mechanism also supported to the main beam. The bow assembly may include a pair of bow limbs that receive a bowstring. The trigger mechanism may be operable to hold the bowstring in a drawn or cocked condition and operable to release the bowstring out of the drawn condition to fire or propel a projectile, such as an arrow, away from the crossbow.

There are many know ways to mount bow limbs to a main beam. For some designs, the bow limbs are mounted directly to the main beam. In other designs, the bow limbs are mounted to a riser which is mounted to the main beam. One know device for mounting a bow limb to a crossbow is known as a limb pocket. As the name implies, a limb pocket defines an opening or pocket into which a bow limb is inserted. Limb pockets may be mounted directly to the main beam or may be mounted to a riser.

Know limb pockets generally work well for their intended purposes. They are known to have limitations, however. One limitation is that known limb pockets do not prevent relative rotational movement of the limb pocket components when the bowstring is drawn and/or released as much as desired. This limitation is especially evident with reverse draw crossbows.

What is needed is a crossbow limb pocket that prevents this limitation.

II. SUMMARY

According to one embodiment of this invention, a crossbow may comprise: a main beam that is adapted to guide an associated projectile; a riser supported to the main beam and comprising first and second sides positioned on opposite sides of the main beam; a bow assembly supported to the riser and comprising: (1) a first bow limb having a first end and a second end that receives a bowstring; and, (2) a second bow limb having a first end and a second end that receives the bowstring; a trigger mechanism that: (1) is supported to the main beam; and, (2) is operable to release the bowstring to propel the associated projectile away from the barrel; and, first and second limb pockets. The first limb pocket may comprise: an inner limb pocket component that comprises: (1) a support surface that mounts the inner limb pocket component to the first side of the riser; (2) a bottom wall; and, (3) first and second side walls that extend from the bottom wall; wherein the walls of the inner limb pocket component define a first limb reception channel that receives the first end of the first bow limb; an outer limb pocket component that comprises: (1) a bottom wall; and, (2) first and second side walls that extend from the bottom wall; wherein the walls of the outer limb pocket component define a second limb reception channel that receives the first end of the first bow limb; and, a first connector that connects the outer limb pocket component to the inner limb pocket component to hold the first end of the first bow limb within the first and second limb reception channels. A first groove may be formed in one of the first side wall of the inner limb pocket component and the first side wall of the outer limb pocket component and a first key may be formed on the other of the first side wall of the inner limb pocket component and the first side wall of the inner limb pocket component. A second groove may be formed in one of the second side wall of the inner limb pocket component and the second side wall of the outer limb pocket component and a second key may be formed on the other of the second side wall of the inner limb pocket component and the second side wall of the outer limb pocket component. The first key may be received within the first groove when the inner limb pocket component is connected to the outer limb pocket component and the second key may be received within the second groove when the inner limb pocket component is connected to the outer limb pocket component. When the first key is received within the first groove and the second key is received within the second groove, relative rotational movement of the inner limb pocket component with respect to the outer limb pocket component may be prevented. The second limb pocket may comprise: an inner limb pocket component that comprises: (1) a support surface that mounts the second limb pocket component to the second side of the riser; (2) a bottom wall; and, (3) first and second side walls that extend from the bottom wall; wherein the walls of the inner limb pocket component define a first limb reception channel that receives the first end of the second bow limb; an outer limb pocket component that comprises: (1) a bottom wall; and, (2) first and second side walls that extend from the bottom wall; wherein the walls of the outer limb pocket component define a second limb reception channel that receives the first end of the second bow limb; and, a second connector that connects the outer limb pocket component to the inner limb pocket component to hold the first end of the first bow limb within the first and second limb reception channels. A first groove may be formed in one of the first side wall of the inner limb pocket component and the first side wall of the outer limb pocket component and a first key may be formed on the other of the first side wall of the inner limb pocket component and the first side wall of the inner limb pocket component. A second groove may be formed in one of the second side wall of the inner limb pocket component and the second side wall of the outer limb pocket component and a second key may be formed on the other of the second side wall of the inner limb pocket component and the second side wall of the outer limb pocket component. The first key may be received within the first groove when the inner limb pocket component is connected to the outer limb pocket component. The second key may be received within the second groove when the inner limb pocket component is connected to the outer limb pocket component. The first key may be received within the first groove and the second key may be received within the second groove to prevent relative rotational movement of the inner limb pocket component with respect to the outer limb pocket component.

According to another embodiment of this invention, a crossbow limb pocket may be used in mounting a bow limb to a crossbow. The crossbow limb pocket may comprise: an inner limb pocket component that comprises: (1) a support surface that mounts the first limb pocket to the crossbow; (2) a bottom wall; and, (3) first and second side walls that extend from the bottom wall; wherein the walls of the inner limb pocket component define a first limb reception channel that receives an end of the bow limb; an outer limb pocket component that comprises: (1) a bottom wall; and, (2) first and second side walls that extend from the bottom wall; wherein the walls of the outer limb pocket component define a second limb reception channel that receives the end of the bow limb;

and, a connector that connects the outer limb pocket component to the inner limb pocket component to hold the end of the bow limb within the first and second limb reception channels. At least one groove may be formed in one of the inner limb pocket component and the outer limb pocket component. At least one key may be formed on the other of the inner limb pocket component and the outer limb pocket component. The first groove may be formed in one of: (1) one of the first and second side walls of the inner limb component; and, (2) one of the first and second side walls of the outer limb component. The first key may be formed on the other of: (1) one of the first and second side walls of the inner limb component; and, (2) one of the first and second side walls of the outer limb component. The first key may be received within the first groove when the inner limb pocket component is connected to the outer limb pocket component.

Many benefits and advantages of this invention will become apparent to those skilled in the art to which it pertains upon reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DEFINITIONS

The following definitions are controlling for this patent:

"Arrow" means a projectile that is shot with (or launched by) a bow assembly.

"Bow" means a bent, curved, or arched object. For crossbows, the bow may include a pair of bow limbs that extend from opposite sides of the main beam.

"Bow Assembly" means a weapon comprising a bow and a bowstring that shoots or propels arrows powered by the elasticity of the bow and the drawn bowstring.

"Bowstring" means a string or cable attached to a bow.

"Compound Bow" means a crossbow that has wheels, pulleys or cams at each end of the bow through which the bowstring passes.

"Crossbow" means a weapon comprising a bow assembly and a trigger mechanism both mounted to a main beam.

"Main Beam" means the longitudinal structural member of a weapon used to support the trigger mechanism and often other components as well. For crossbows, the main beam also supports the bow assembly. The main beam often comprises a stock member, held by the person using the weapon, and a barrel, used to guide the projectile being shot or fired by the weapon.

"Riser" means the portion of a crossbow that attaches the bow limbs to the main beam. In some cases a riser is not required as the bow limbs attach directly to the main beam.

"Trigger Mechanism" means the portion of a weapon that shoots, fires or releases the projectile of a weapon. As applied to crossbows, trigger mechanism means any device that holds the bowstring of a crossbow in the drawn or cocked condition and which can thereafter be operated to release the bowstring out of the drawn condition to shoot an arrow.

"Weapon" means any device that can be used in fighting or hunting that shoots or fires a projectile including bow assemblies and crossbows.

V. DETAILED DESCRIPTION

Figure 1:
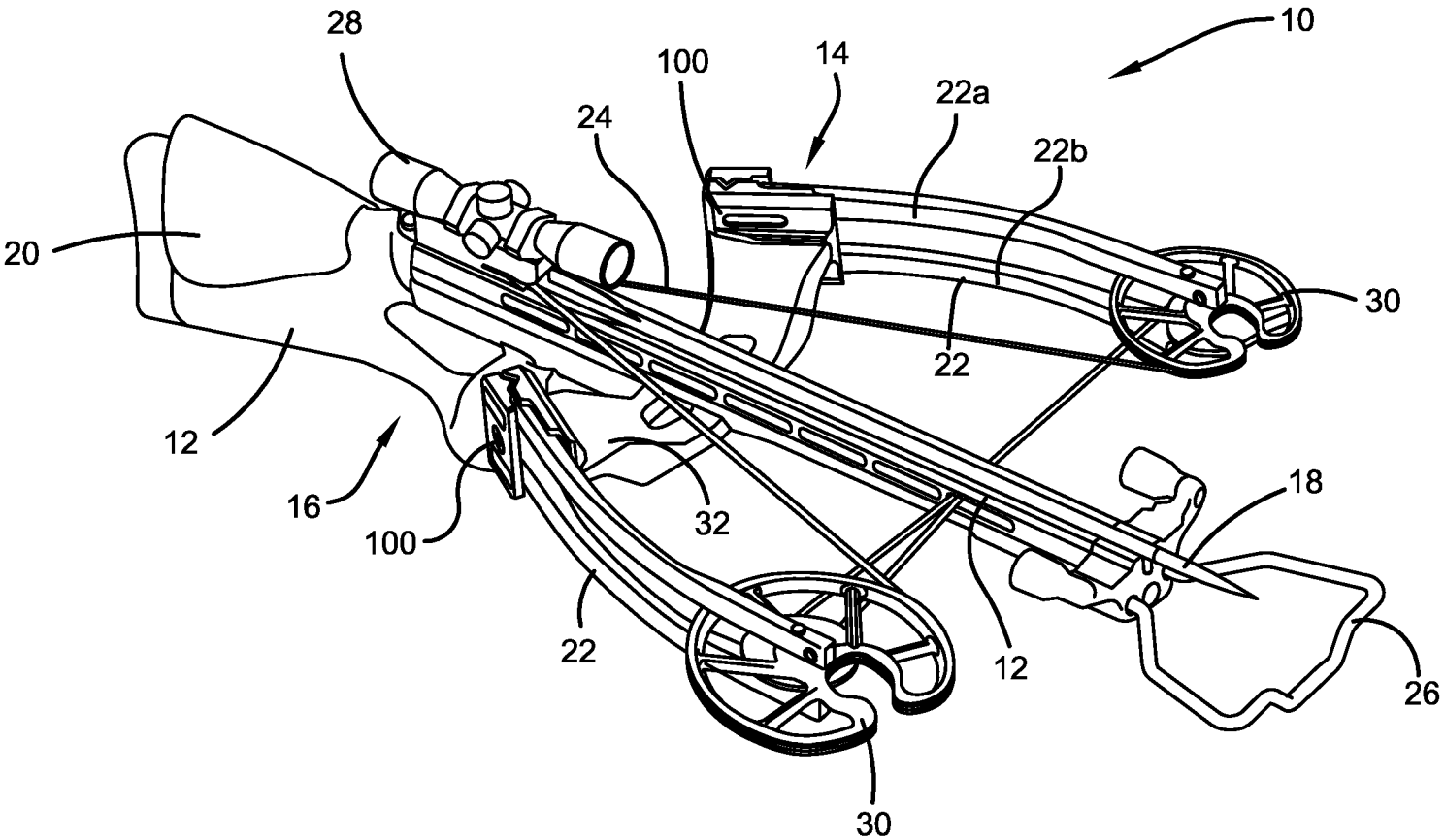
FIG. 1 is a perspective view of a crossbow equipped with a pair of limb pockets according to some embodiments of the invention.
Figure 2:
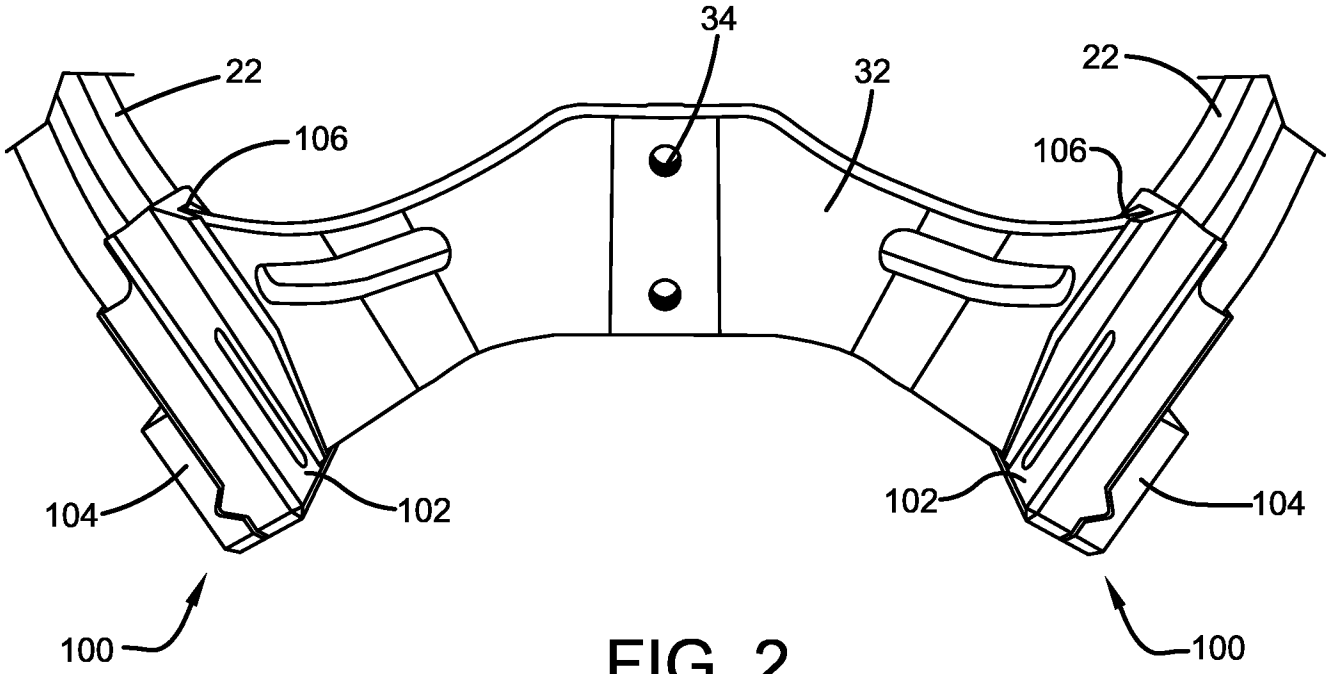
FIG. 2 is a top view of the crossbow riser shown in FIG. 1 with some components removed for clarity.

Referring now to the drawings wherein the showings are for purposes of illustrating embodiments of the invention only and not for purposes of limiting the same, and wherein like reference numerals are understood to refer to like components, FIG. 1 shows a crossbow 10 equipped with a pair of limb pockets 100 according to some embodiments of this invention. The crossbow 10 may include a main beam 12 that extends longitudinally, a bow assembly 14 supported to the main beam 12 and a trigger mechanism 16 supported to the main beam 12. The main beam 12 may support and guide a projectile, such as arrow 18, to be fired or shot by the bow assembly 14. The main beam 12 may have a distal end which supports the projectile 18 and a proximal end that includes a shoulder support portion 20 enabling the crossbow 10 to be held by the user when firing the crossbow 10 similar to a rifle. The trigger mechanism 16 may be operable to hold a bowstring 24 in a drawn or cocked condition (as shown in FIG. 1) and operable to release the bowstring 24 out of the drawn condition to fire or propel the projectile 18. The main beam 12 and trigger mechanism 16 may be of any type and style chosen with the sound judgment of a person of skill in the art. The crossbow 12 may include additional components as desired without departing from this invention, but none are required. The crossbow 12 shown, for example, includes a stirrup 26 mounted to the distal end of the main beam 12 and a scope 28 also supported to the main beam 12.

With continuing reference to FIG. 1, the bow assembly 14 may include a pair of bow limbs 22, 22 that extend from opposite sides of the main beam 12 and that receive the bowstring 24. Each bow limb 22 shown is a split limb that comprises first and second portions 22*a*, 22*b* but this invention will work with any type of bow limb chosen with the sound judgment of a person of skill in the art. Wheels and/or cams 30 may be mounted to the distal ends of the bow limbs 22, as shown, making the bow assembly 14 a compound bow but this invention will work with any type of bow assembly chosen with the sound judgment of a person of skill in the art. The proximal ends of the bow limbs 22 may be mounted to respective limb pockets 100 as will be discussed further below. In one embodiment, the limb pockets 100 are supported to the main beam 12 by being mounted directly to the main beam 12. For the embodiment shown, the limb pockets 100 are supported to the main beam 12 by being mounted to a riser 32 that is mounted to the main beam 12. The crossbow shown is known as a reverse draw crossbow because the bow limbs 22, 22 extend distally (away from shoulder support 20 and toward stirrup 26) from their proximal ends that are mounted to the main beam 12 to their distal ends that engage the bowstring 24. The limb pockets 100 of this invention, however, may have applicability to other types of crossbows and may have applicability in non-crossbow applications as well.

Figure 18:
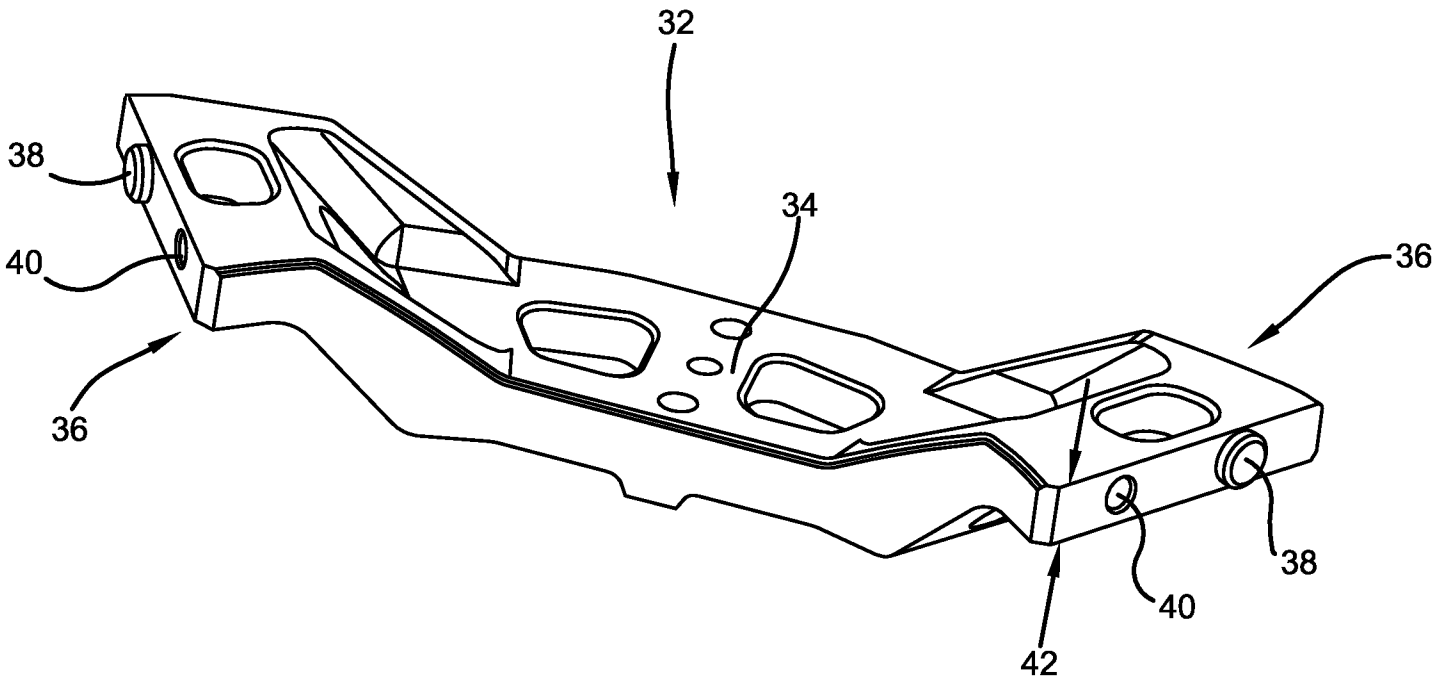
FIG. 18 is a perspective view of a riser according to some embodiments of this invention.
Figure 19:
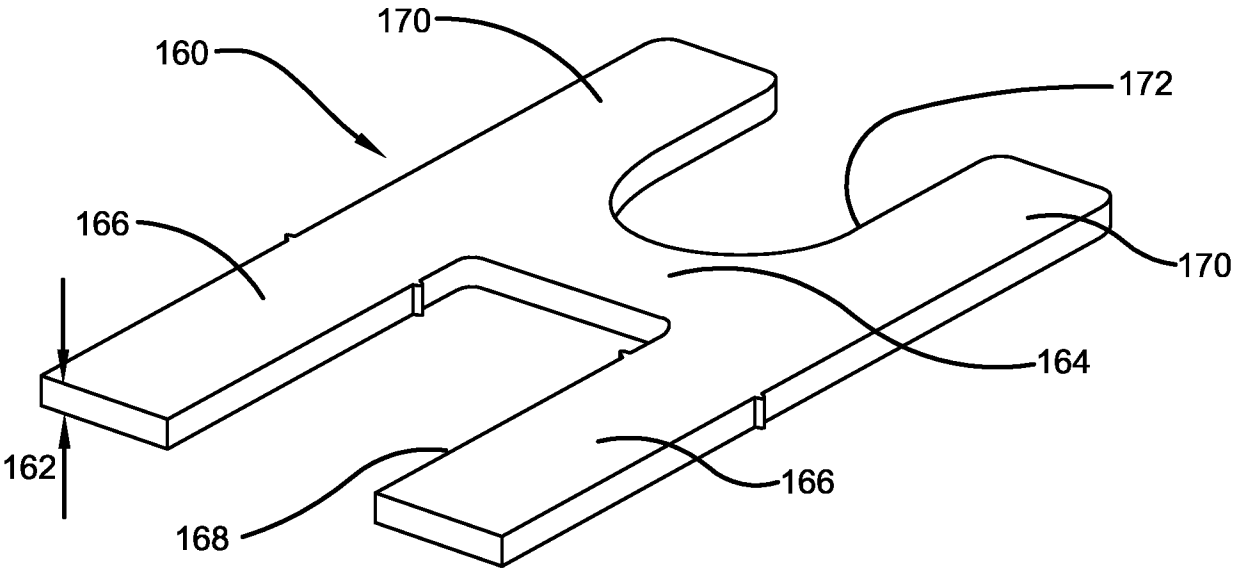
FIG. 19 is a perspective view of a plate according to some embodiments of this invention.
Figure 20:
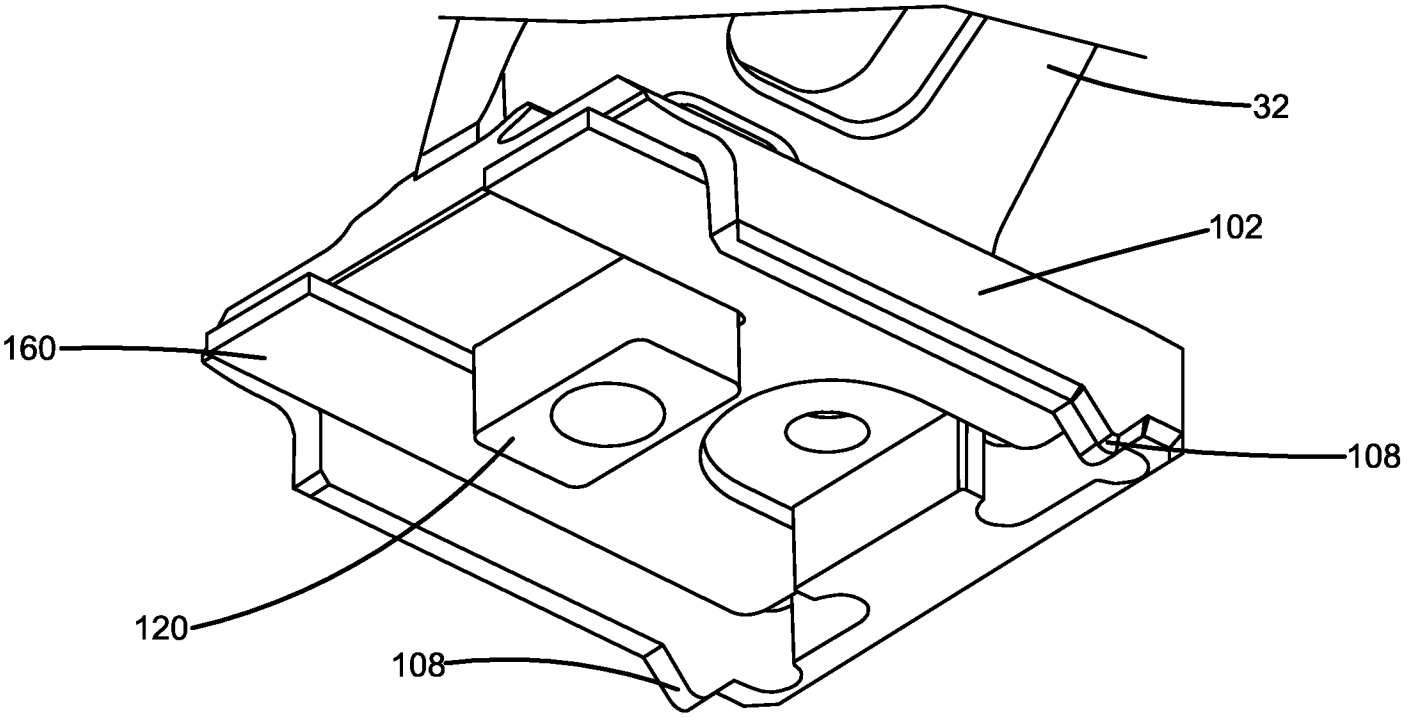
FIG. 20 is a perspective bottom view of a portion of a limb pocket according to some embodiments of this invention.

With reference now to FIGS. 1-2, 18, 23-24 and 26, the crossbow limb pockets 100, 100 are shown mounted to opposite sides of the riser 32. The riser 32 may have a mid-section 34 that is mounted to the main beam 12 in a known manner. The riser 32 may also have first and second sides 36, 36 that are positioned on opposite sides of the main beam 12 when the riser 32 is attached to the main beam 12. Each side 36 may include, as shown in FIG. 18, a boss 38 that extends outwardly from the riser and an opening 40. Each boss 38 may have any shape or size chosen with the sound judgment of a person of skill in the art. For the embodiment shown, each boss 38 has a circular cross-section. Each side 36 of the riser 32 may also have a thickness 42. The purposes and use of the boss 38, opening 40 and thickness 42 will be discussed below.

Figure 3:
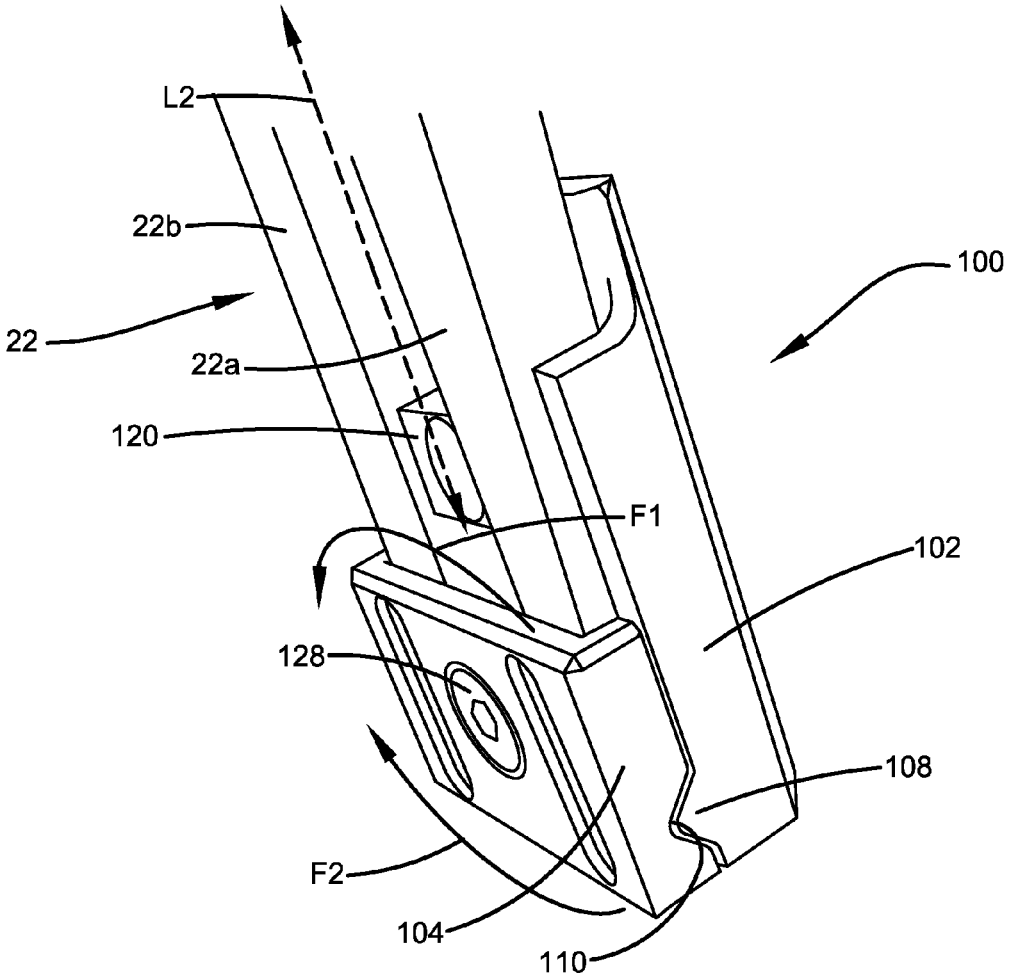
FIG. 3 is a close up perspective view of a limb pocket according to some embodiments of this invention.
Figure 5:
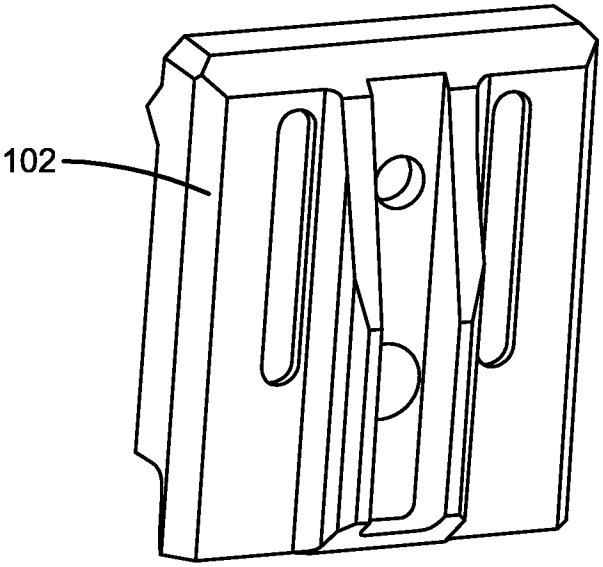
FIG. 5 is a top perspective view of the outer limb pocket component shown in FIG. 4.
Figure 4:
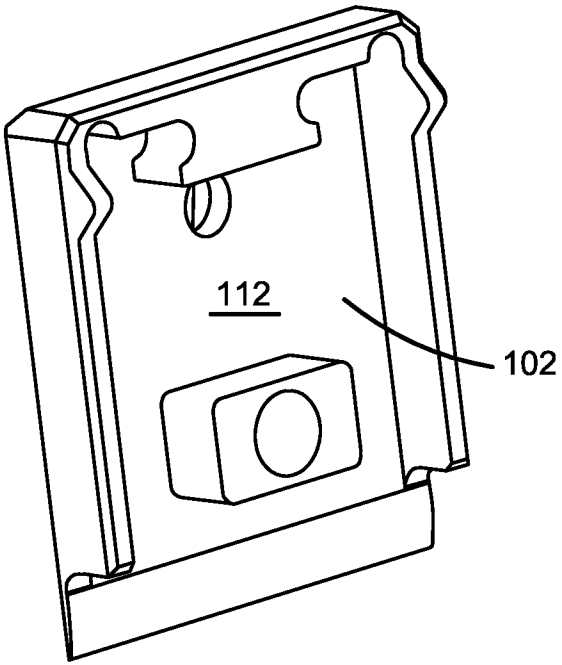
FIG. 4 is a bottom perspective view of an outer limb pocket component according to some embodiments of this invention.
Figure 6:
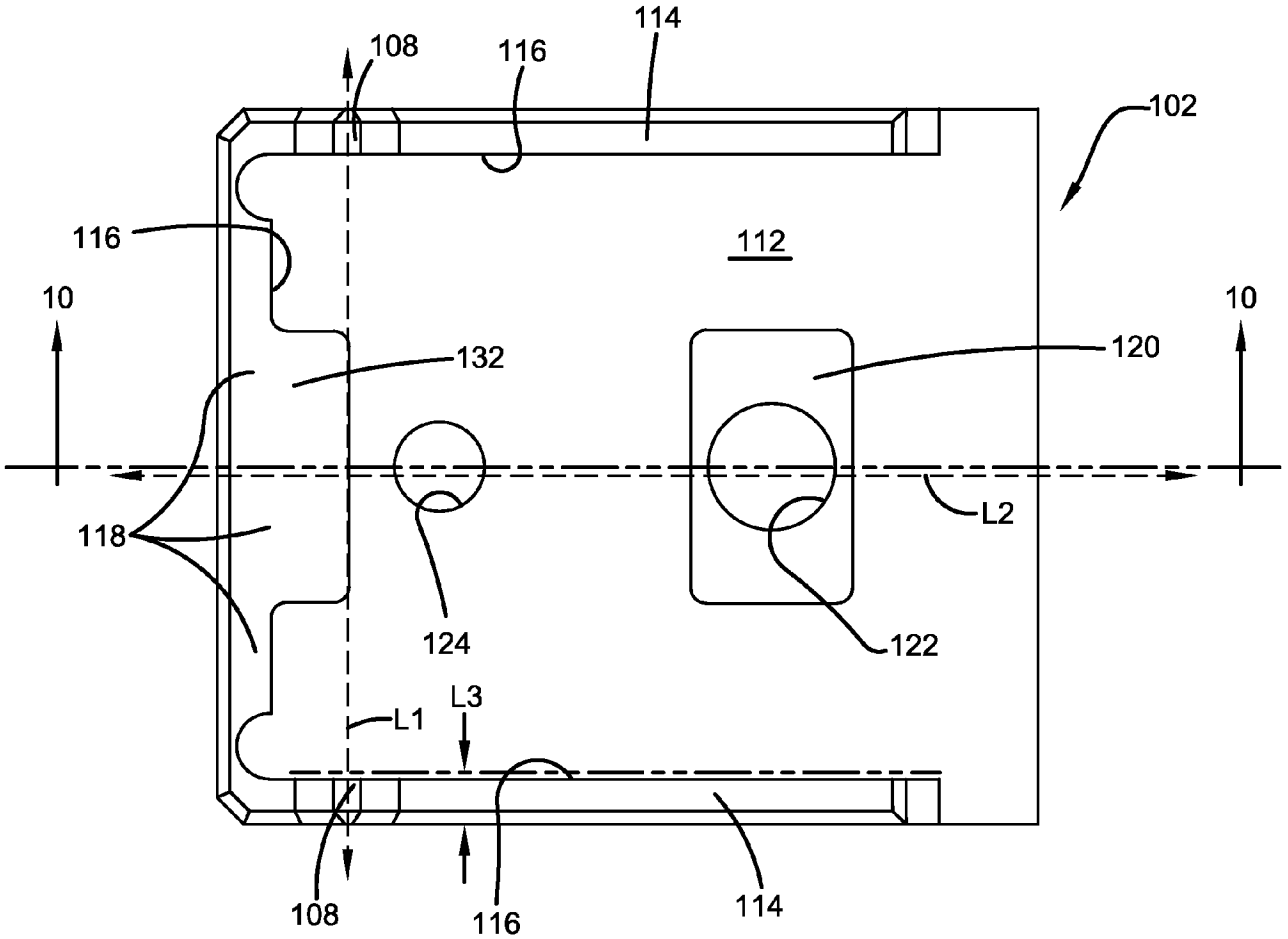
FIG. 6 is a bottom view of the outer limb pocket component shown in FIG. 1.
Figure 25:
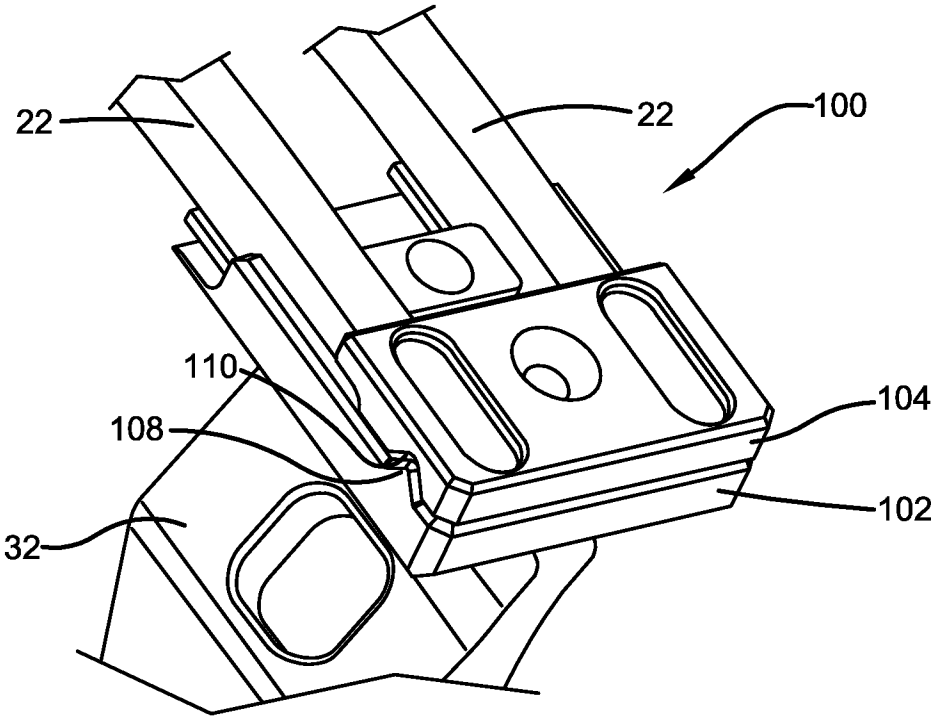
FIG. 25 is a perspective side view showing a limb pocket connected to a bow limb and a riser according to some embodiments of this invention.
Figure 26:
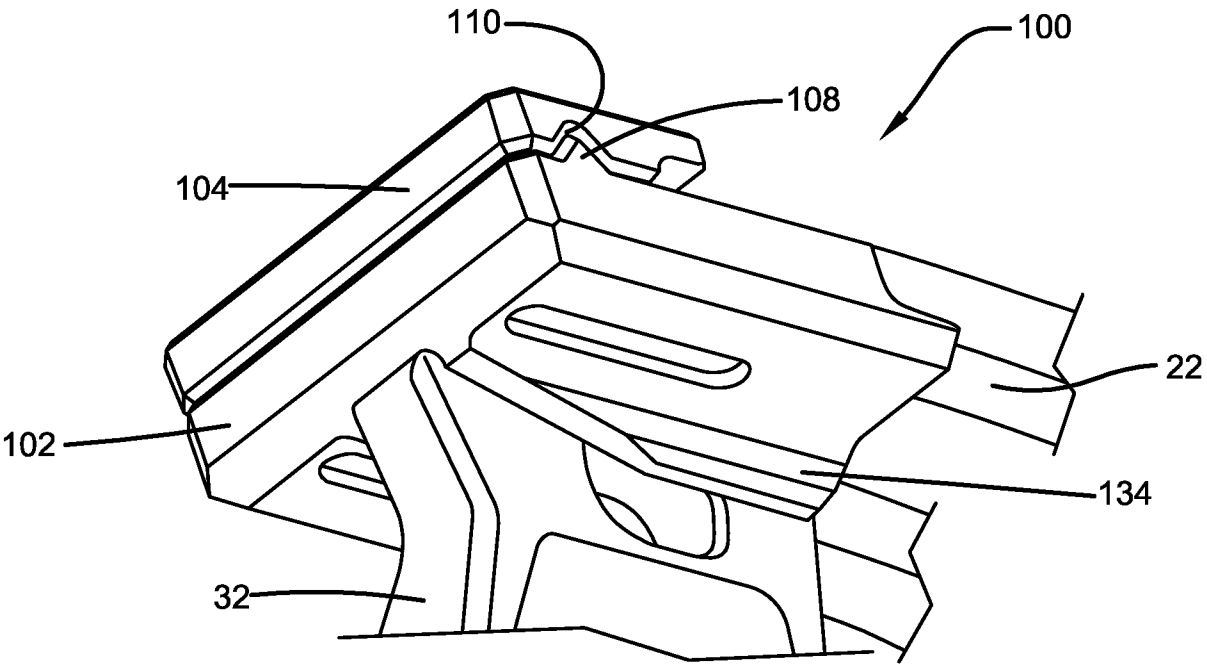
FIG. 26 is a view similar to that shown in FIG. 25 but from a different angle.

With reference now to FIGS. 1-3 and 25-26, each limb pocket 100 may include an inner limb pocket component 102 and an outer limb pocket component 104. Because each limb pocket 100 may be made of the same components, the description to follow may apply to as many limb pockets as may be used (one or more). FIGS. 3 and 25-26, show close-up views of a limb pocket 100 receiving the proximal end of bow limb 22 which, in one non-limiting embodiment, may be a split limb comprising first and second portions 22*a*, 22*b*. When the bowstring is drawn and released, forces F1, F2 shown in FIG. 3 are created and applied to the limb pocket 100. These forces F1, F2 are detrimental as they may cause a reduction in power to the projectile. They may also cause the inner limb pocket component 102 to rotate with respect to the outer limb pocket component 104. To resist these forces F1, F2 and prevent this relative rotational movement between inner limb pocket component 102 and outer limb pocket component 104, at least one key 108 on one component may be received in at least one groove 110 in the other component. By "key" it is meant a relative convex shape and by "groove" it is meant a relative concave shape. It should be noted that while forces F1 and F2 may be centered on the longitudinal axis of connector 128, this invention will also resist other forces as is understood by a person of skill in the art.

Figure 23:
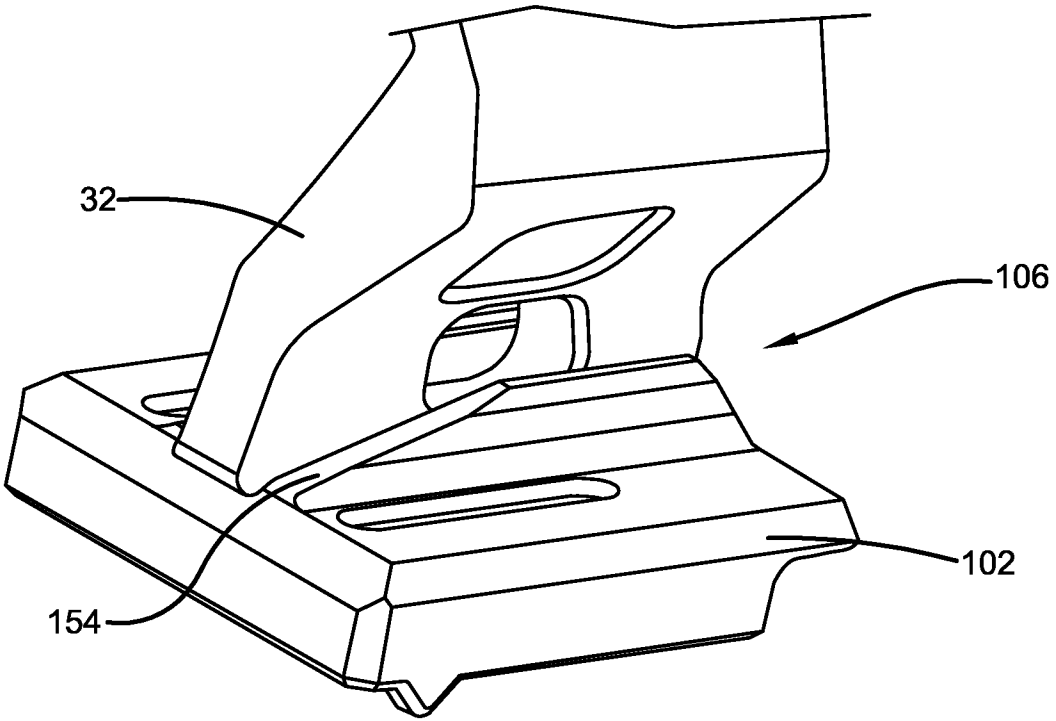
FIG. 23 is a top perspective view of a riser connected to the inner limb pocket component according to some embodiments of this invention.
Figure 24:
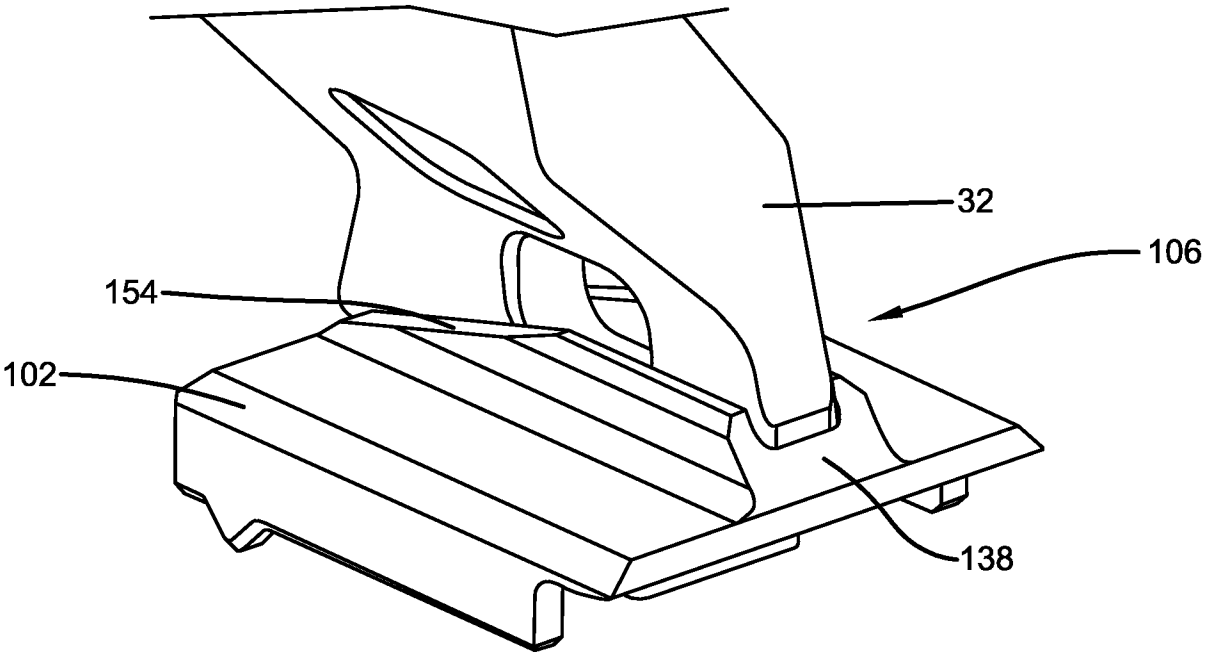
FIG. 24 is a view similar to that shown in FIG. 23 but from a different angle.

With reference now to FIGS. 3-10, 18, 21-24 and 26, each inner limb pocket component 102 may include a support surface 106 that mounts the inner limb pocket component 102, and thus the limb pocket 100, to the crossbow. For the embodiment shown, the support surfaces 106, 106, mount the respective limb pockets 100, 100 to opposite sides 36, 36 of the riser 32. In one embodiment, one of the riser side 36 and the support surface 106 comprises a boss and the other comprises a hole that receives the boss to connect that side of the riser to the support surface 106 of the inner limb pocket component 102. For the embodiment shown, each riser side 36 comprises a boss 38 that is received in a hole 122 formed in the support surface 106. Hole 122 may extend through inner limb pocket component 102, as shown. FIGS. 23 and 24 show one side of the riser 32 connected to the support surface 106 of the inner limb pocket component 102. In another embodiment, not shown, the boss extends from the support surface 106 and the hole is formed in the side 36 of the riser 32.

With continuing reference to FIGS. 3-10, 18, 21-24 and 26, in another embodiment each support surface 106 comprises a pair of opposing generally parallel side extensions 134, 134 that define between them a slot 136. The slot 136 may receive the corresponding side 36 of the riser 32 to connect support surface 106 to the riser side 36. Thus, the thickness 42 of the riser 36 shown in FIG. 18, is less than or equal to the distance between the extensions 134, 134. In one specific embodiment, shown, an end extension 138 is positioned at one end of the slot 136 to form a stop which limits how far the riser side 36 can be inserted within the slot 136. In one specific embodiment, the end extension 138 connects to both extensions 134, 134. FIGS. 23 and 24 show one side of the riser 32 connected to the support surface 106 of the inner limb pocket component 102. In one embodiment, referenced in FIGS. 23 and 24, each side extension 134 has a tapered section 154 opposite the end extension 138 to make it easier to position the riser 32 within the support surface 106.

Figure 7:
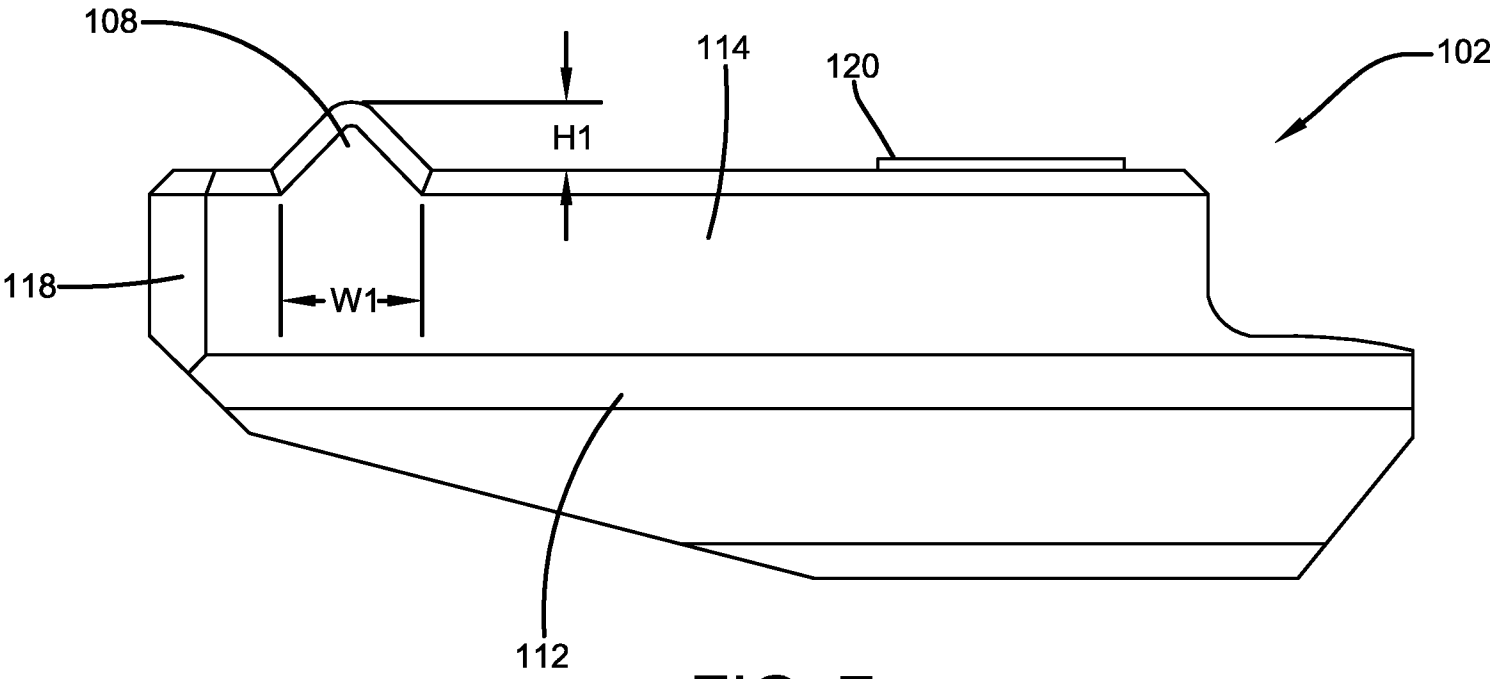
FIG. 7 is a side view of the outer limb pocket component shown in FIG. 1.
Figure 7A:
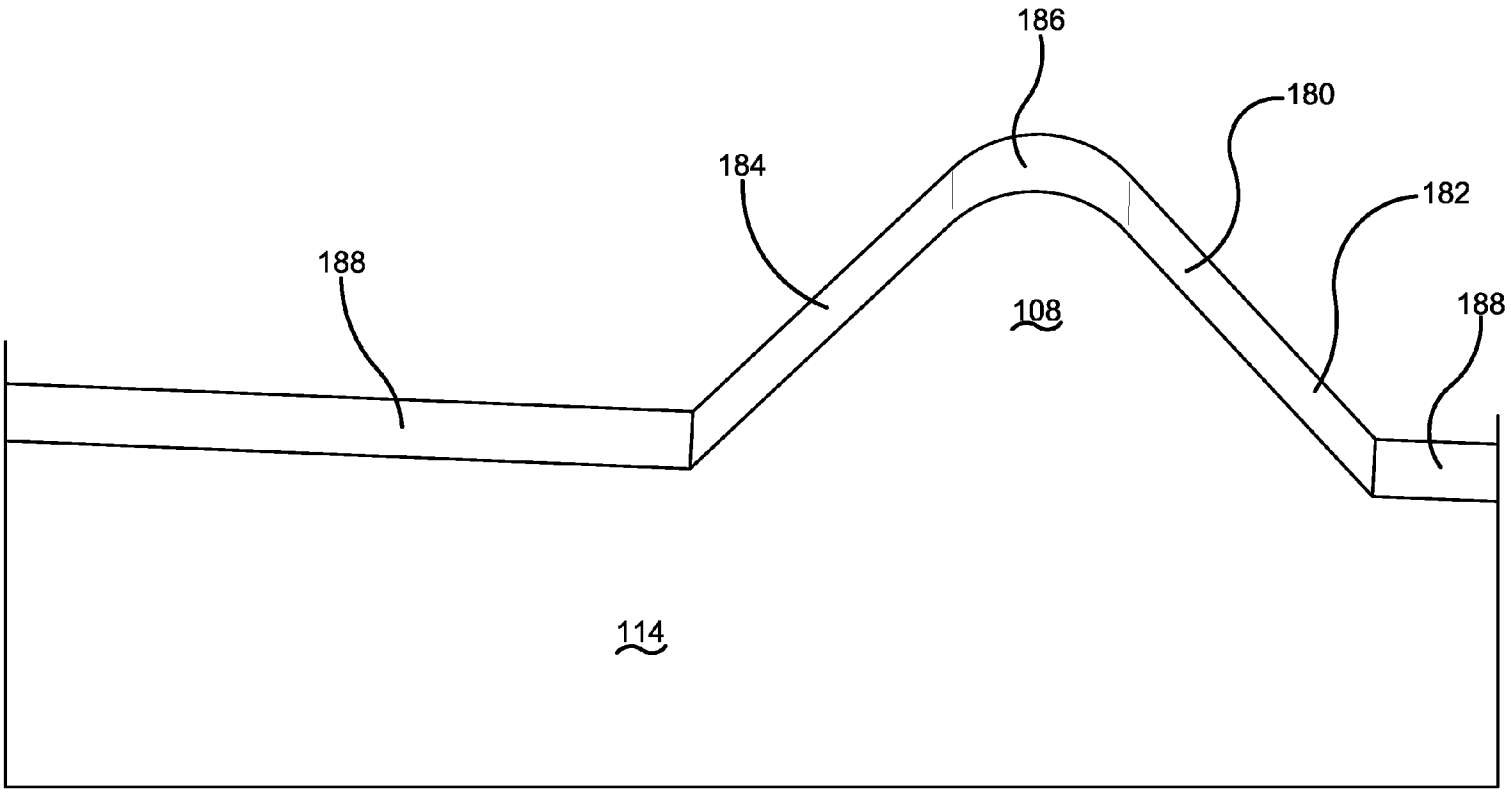
FIG. 7A is a close-up side view of a key according to some embodiments of this invention.
Figure 8:
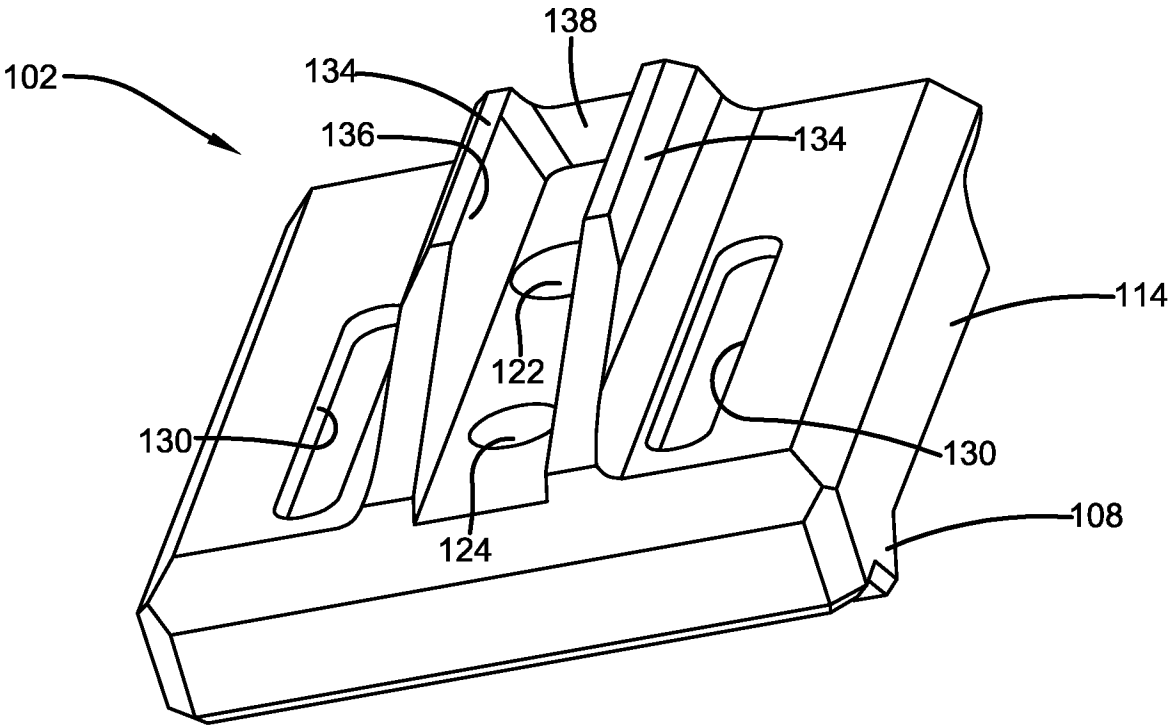
FIG. 8 is a perspective end view of the outer limb pocket component shown in FIG. 1.
Figure 9:
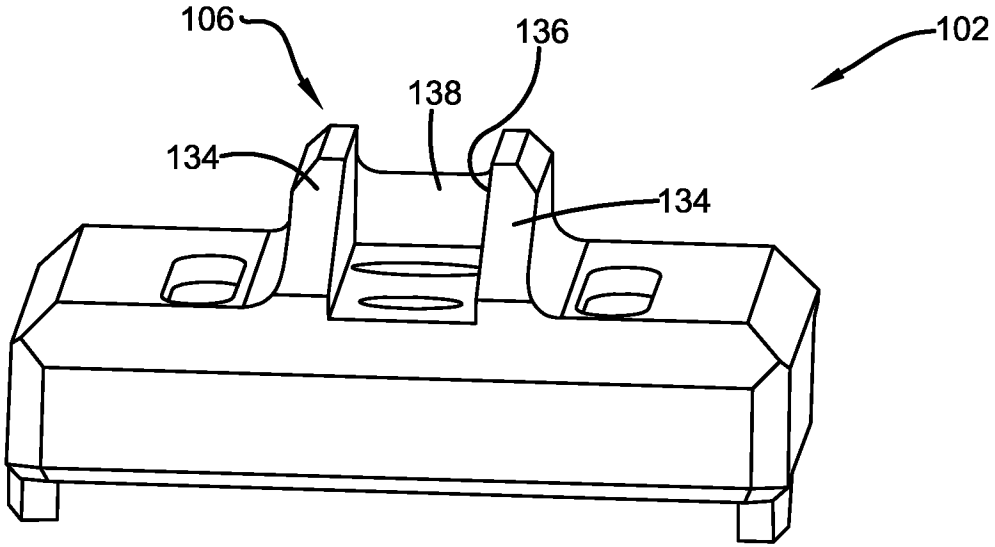
FIG. 9 is a perspective end view similar to that shown in FIG. 8 but from a different angle.
Figure 10:
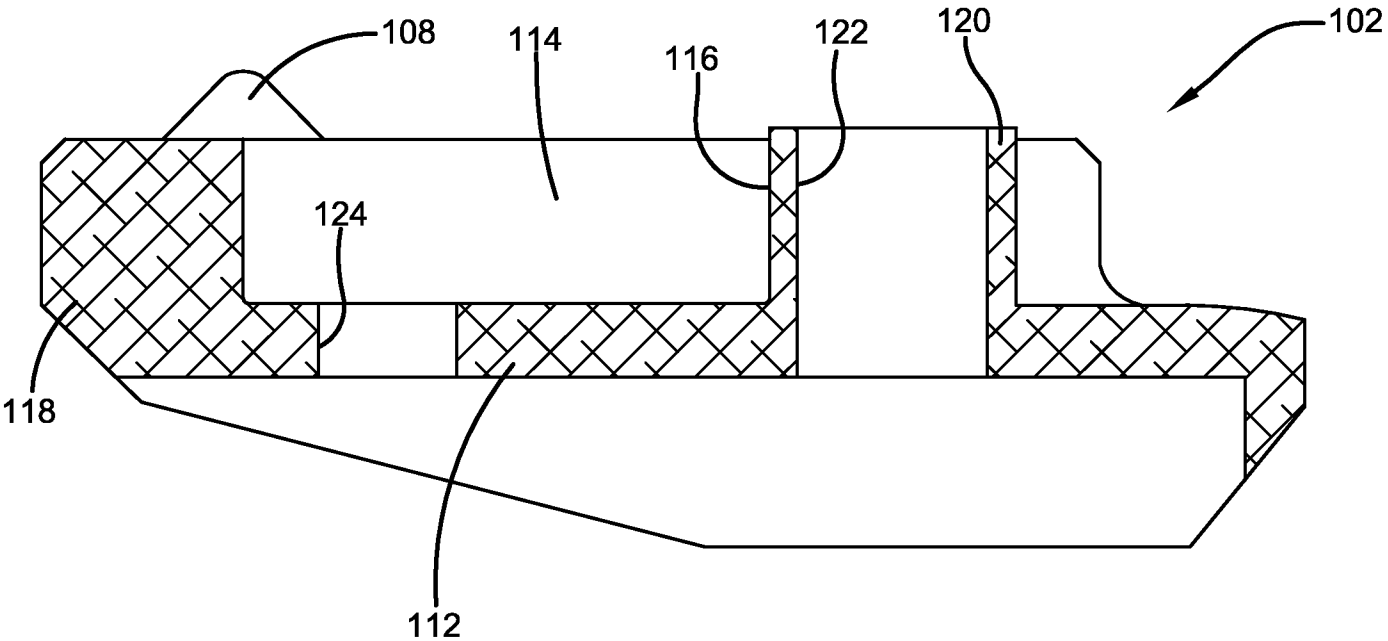
FIG. 10 is a sectional view taken along line 10-10 of FIG. 6.
Figure 12:
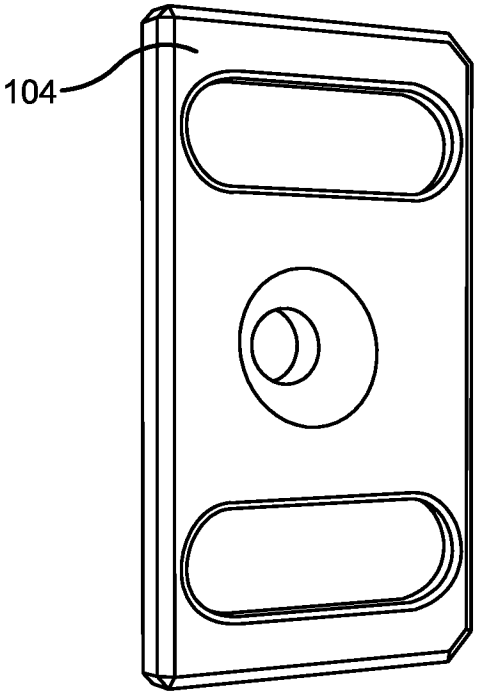
FIG. 12 is a top perspective view of the inner limb pocket component shown in FIG. 11.
Figure 11:
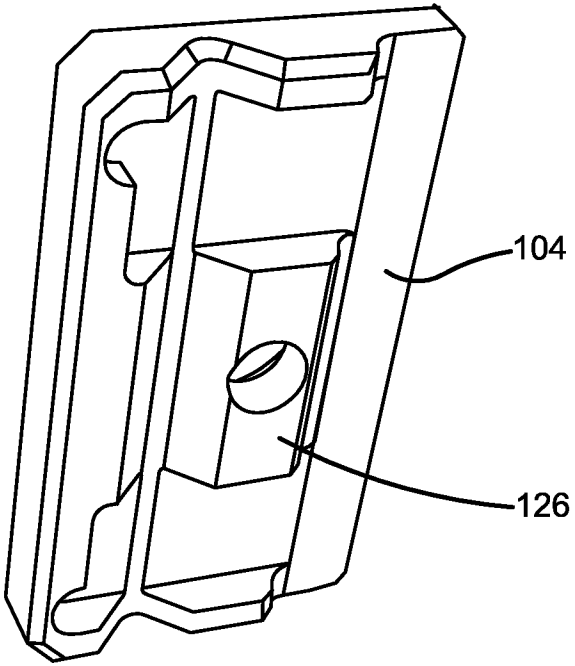
FIG. 11 is a bottom perspective view of an inner limb pocket component according to some embodiments of this invention.
Figure 13:
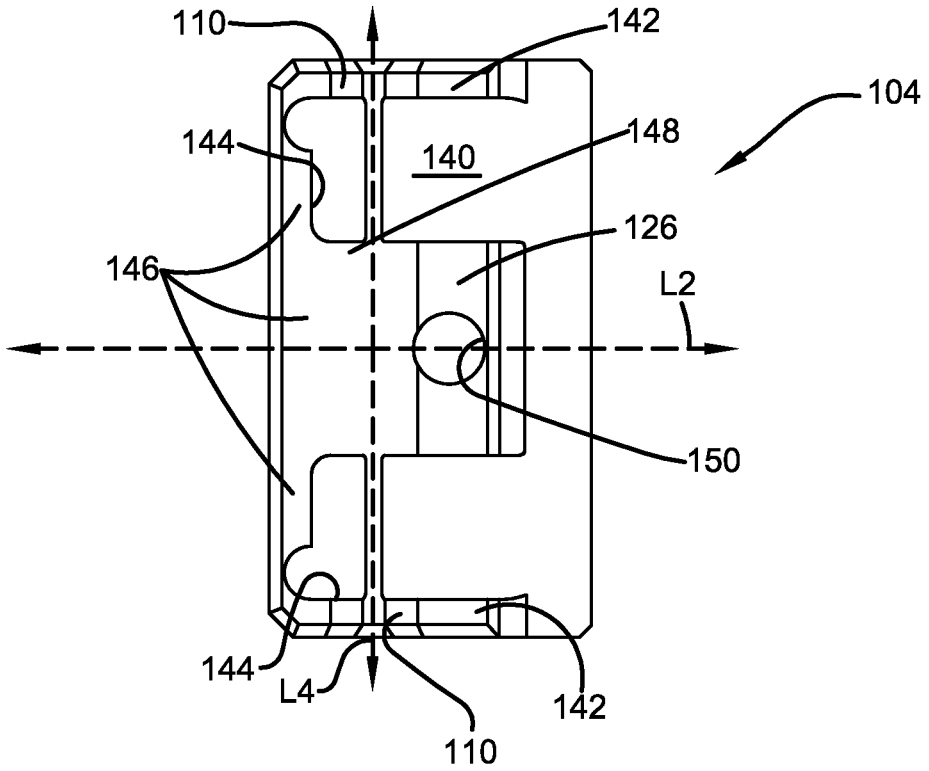
FIG. 13 is a bottom view of the inner limb pocket component shown in FIG. 11.
Figure 14:
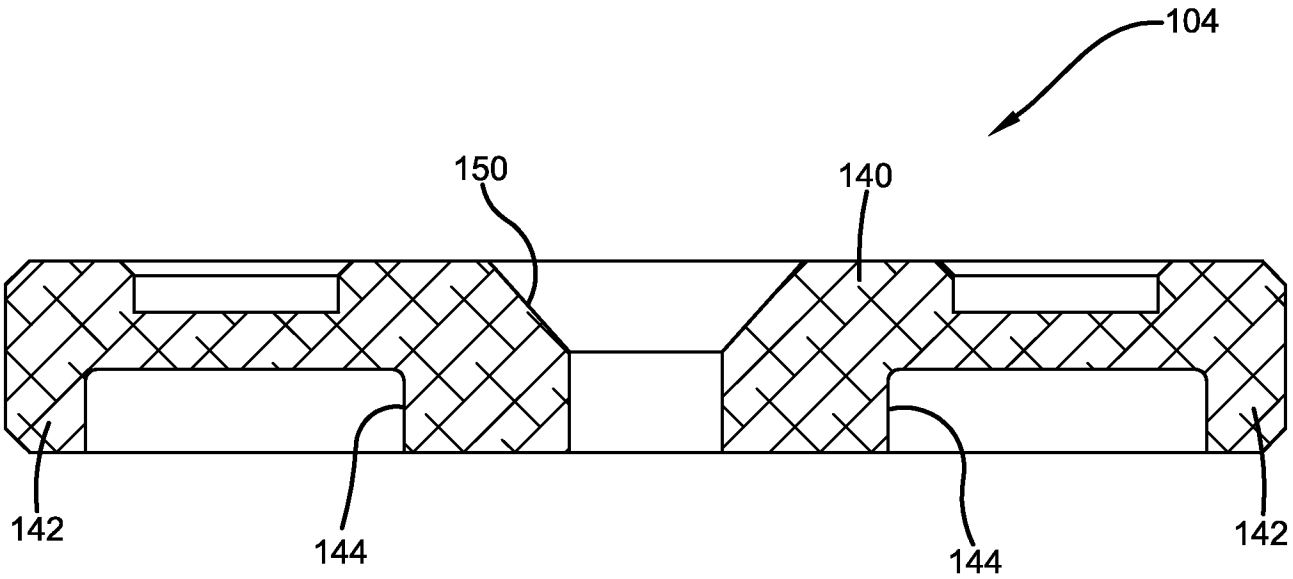
FIG. 14 is a sectional side view taken along the line 14-14 of FIG. 16.
Figure 15:
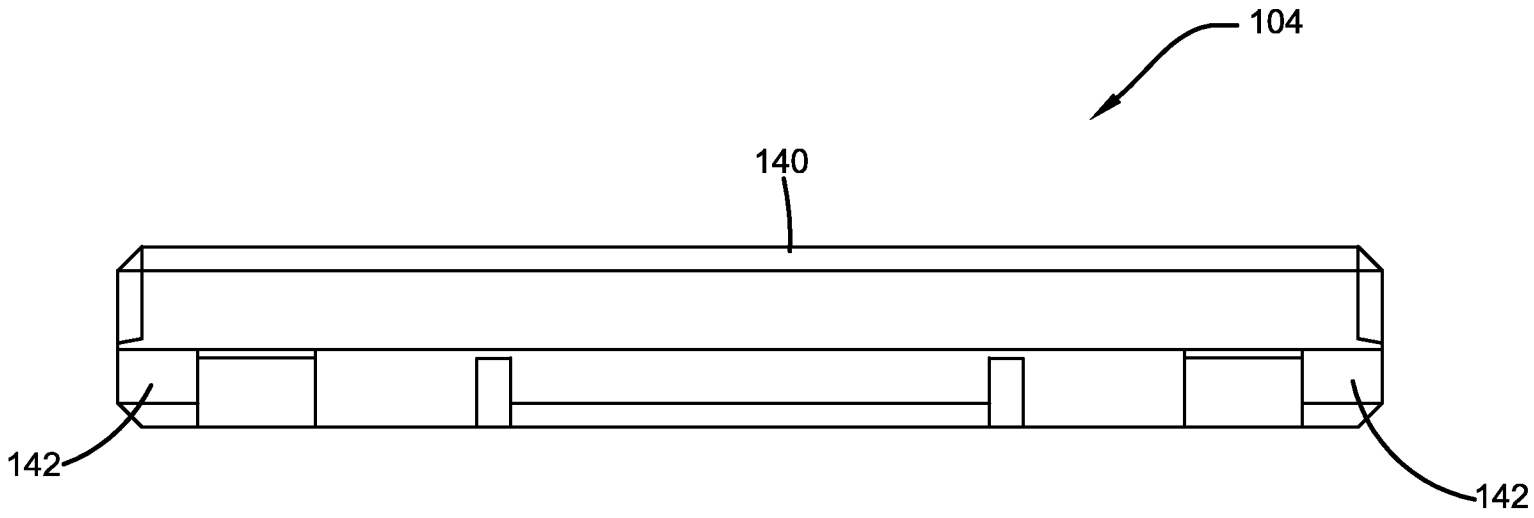
FIG. 15 is an end view of the inner limb pocket component shown in FIG. 11.
Figure 16:
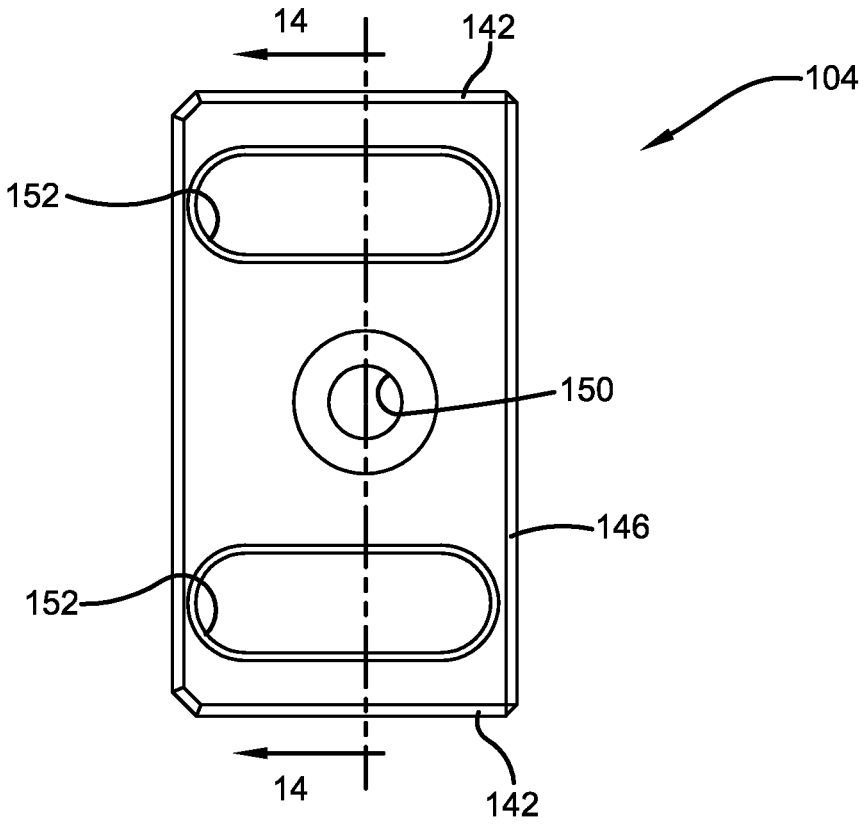
FIG. 16 is a top view of the inner limb pocket component shown in FIG. 11.

With reference now to FIGS. 3-10, 18 and, 20-26, the inner limb pocket component 102 may include a bottom wall 112 and a pair of side walls 114, 114 that extend from the bottom wall 112. These walls 112, 114, 114 may define a limb reception channel 116 that receives an end of the bow limb 22, as shown in FIGS. 3, 22 and 25-26. The inner limb pocket component 102 may also include a back wall 118 that may also define the limb reception channel 116. At least one key 108, two shown, may be formed on the inner limb pocket component 102. For the embodiment shown, each key 108 is formed on a side wall 114. With reference to FIG. 7A, each key 108 may be defined by a key surface 180 that has a first portion 182, a second portion 184 and a mid-portion 186. The mid-portion 186 is positioned between the first and second portions 182, 184 and may extend, as shown, outwardly farther than the first and second portions 182, 184. The mid-portion 186 may have a curved surface, as shown. For the embodiment shown, the key 108 extends outwardly from a top surface 188 of the side wall 114. In one embodiment, the mid-portion 186 may be positioned half way, i.e., centered, between the ends of the key 108, as shown. In alternate embodiments, the mid-portion 186 is not centered.

With reference now to FIGS. 4-10 and 20-26, the keys 108, 108 may be positioned on opposite sides of the limb reception channel 116 and thus on opposite sides of the bow limb 22. The keys 108, 108 may be collinear along a line L1 that is substantially perpendicular to the longitudinal axis L2 of the inner limb pocket component 102 and the bow limb 22. While each key 108 may have any size and shape chosen with the sound judgment of a person of skill in the art, for the embodiments shown (see FIG. 7), each key 108 has a V-shape with a height H1 measured from the neighboring top 188 of the side wall 114, a width W1 and a length L3 (see FIG. 6). In one specific non-limiting example, height H1 is approximately 0.2 inches, width W1 is approximately 0.4 inches and length L3 is approximately 0.2 inches. For the embodiment shown, key length L3 is substantially the same as the thickness of side wall 114.

Figure 21:
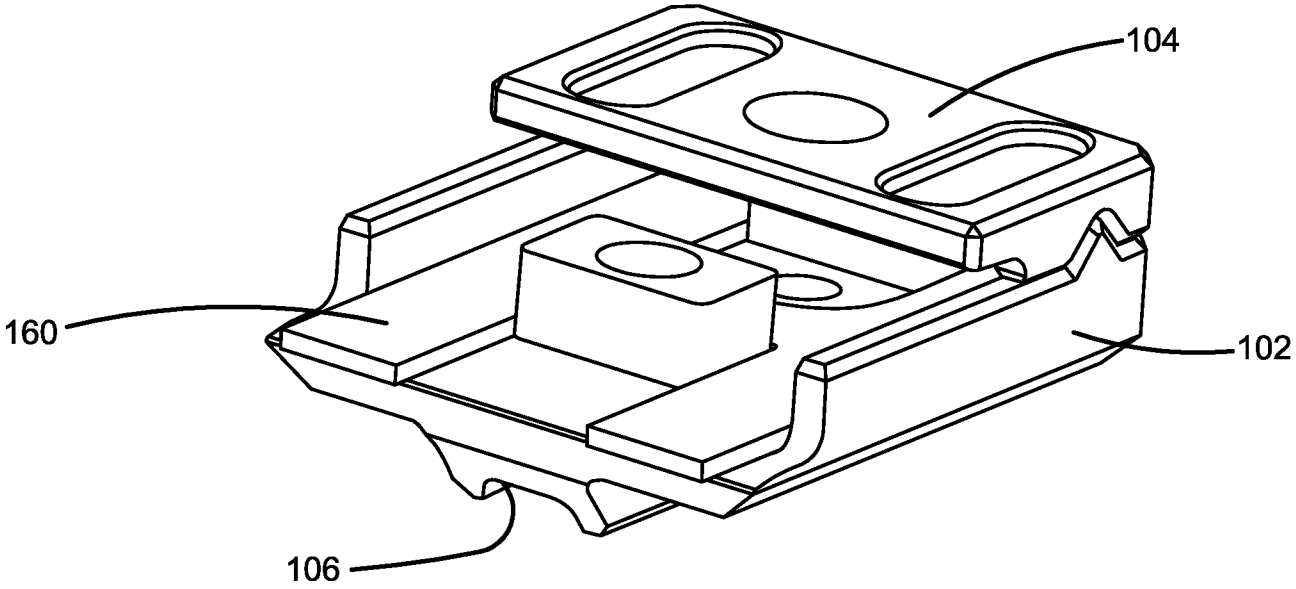
FIG. 21 is an end perspective view of a portion of a limb pocket according to some embodiments of this invention.
Figure 22:
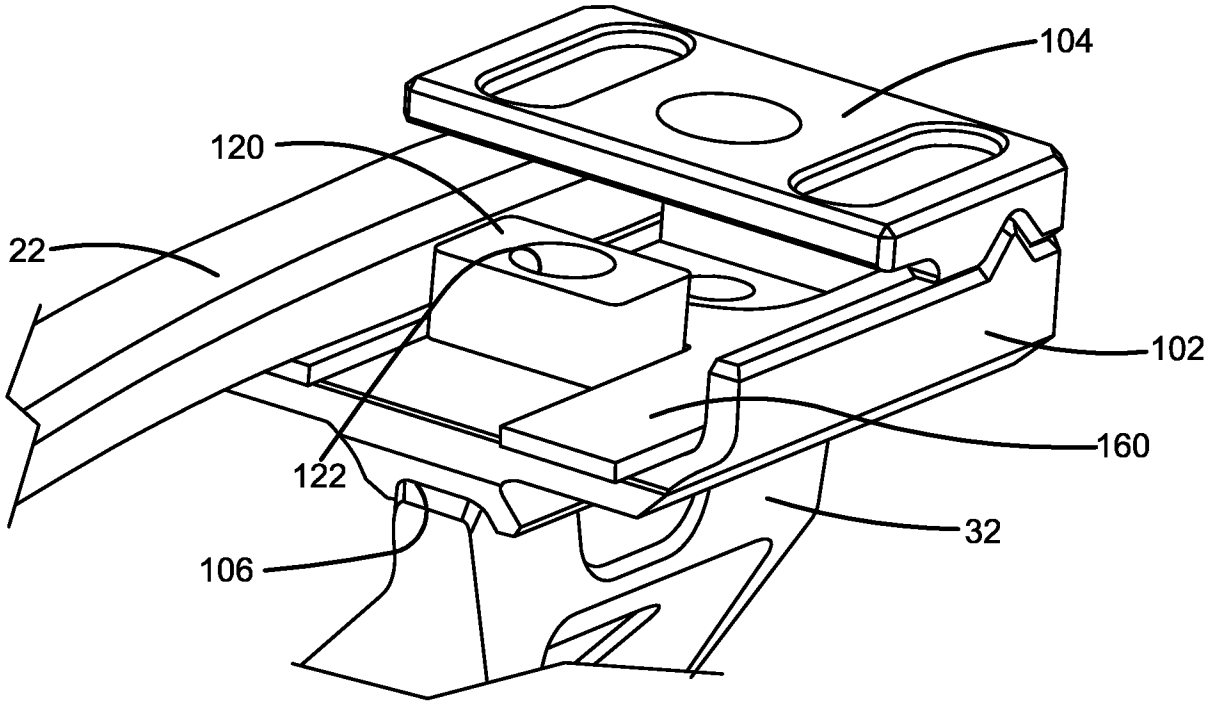
FIG. 22 is a view similar to that shown in FIG. 21 but with the riser and a portion of the bow limb added.

With continuing reference to FIGS. 3-8, 10, 18, 20-22 and 25, the inner limb pocket component 102 may also comprise a spacer 120 that may extend from the bottom wall 112, as shown. The spacer 120 may be used, as shown in FIGS. 3, 22 and 25, to maintain separation between the bow limb portions 22*a*, 22*b* by extending between the bow limb portions 22*a*, 22*b*. As a result, the bow limb portions 22*a*, 22*b* are received on opposite sides of the limb reception channel 116, as shown in FIGS. 22 and 25. In one embodiment, the back wall 118 may include an inwardly extending portion 132 that also maintains the separation between the bow limb portions. The inner limb pocket component 102 may include an opening 124 that extends through the bottom wall 112. Previously described hole 122 may extend, as shown, through spacer 120. This minimizes the required material and therefore lightens the component mass and may provide additional surface area for the boss 38 to contact. Opening 124 may receive a connector 128 (see FIG. 3) to mount the outer limb pocket component 104 to the inner limb pocket component 102. In one embodiment, shown, connector 128 also extends into the opening 40 formed on the side 36 of the riser 32 where it may be attached to the riser 32 and thus to the main beam 12 such as with engaging threads. To reduce the amount of material required, the inner limb pocket component 102 may have one or more slots 130, as shown in FIGS. 5, 8, 23-24 and 26.

Figure 17:
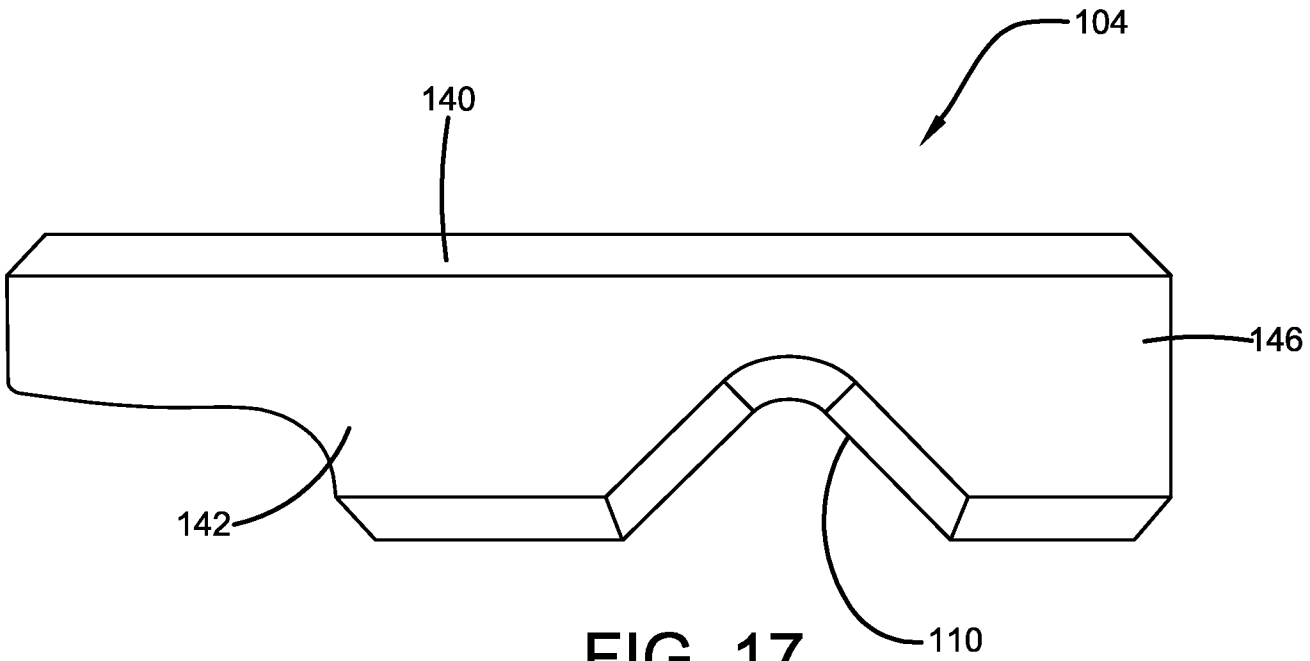
FIG. 17 is an end view of the inner limb pocket component shown in FIG. 11.
Figure 17A:
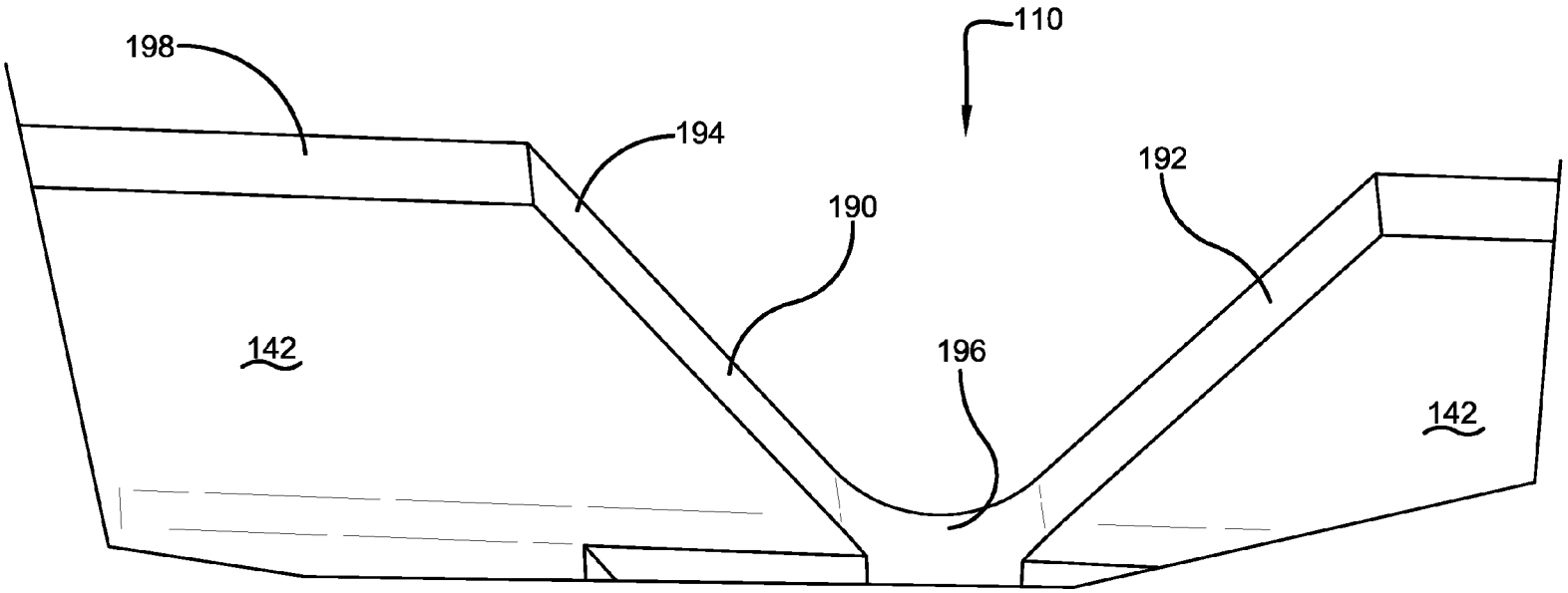
FIG. 17A is a close-up side view of a groove according to some embodiments of this invention.

With reference now to FIGS. 3 and 11-17A, 21-22 and 25-26, the outer limb pocket component 104 may include a bottom wall 140 and a pair of side walls 142 that extend from the bottom wall 140. These walls 140, 142, 142 may define a limb reception channel 144 that receives an end of the bow limb 22, as shown in FIGS. 3, 22 and 25-26. The outer limb pocket component 104 may also include a back wall 146 that may also define the limb reception channel 144. In one embodiment, the back wall 146 may include an inwardly extending portion 148 that maintains the separation between the bow limb portions 22*a*, 22*b*. At least one groove 110, two shown, may be formed on the outer limb pocket component 104. For the embodiment shown, each groove 110 is formed in a side wall 142. With reference to FIG. 17A, each groove 110 may be defined by a groove surface 190 that has a first portion 192, a second portion 194 and a mid-portion 196. The mid-portion 196 is positioned between the first and second portions 192, 194 and may extend, as shown, inwardly farther than the first and second portions 192, 194. The mid-portion 196 may have a curved surface, as shown. For the embodiment shown, the groove 110 extends inwardly from a top surface 198 of the side wall 142. In one embodiment, the mid-portion 196 may be positioned half way, i.e., centered, between the ends of the groove 110, as shown. In alternate embodiments, the mid-portion 196 is not centered.

With reference now to FIGS. 3, 6 and 11-17, 21-22 and 25-26, the grooves 110, 110 may be positioned on opposite sides of the limb reception channel 144 and thus on opposite sides of the bow limb 22. The grooves 110, 110 may be collinear along a line L4 that is substantially perpendicular to the longitudinal axis L2 of the outer limb pocket component 104 and the bow limb 22. With the relative locations of the line L1 and connector opening 124 (FIG. 6) and the line L4 and connector opening 150 (FIG. 13), when each key 108 is received in a corresponding groove 110, a line that intersects the mid-portions of the key surfaces (L1) does not intersect either of the connector openings 124, 150. While each groove 110 may have any size and shape chosen with the sound judgment of a person of skill in the art, for the embodiments shown (see FIGS. 11 and 17), each groove 110 has a V-shape with a depth, width and length that matches the height, width and length (H1, W1 and L3) of each corresponding key 108. For the embodiment shown, groove length is substantially the same as the thickness of side wall 142.

With continuing reference to FIGS. 3 and 11-17, 21-22 and 25-26, the outer limb pocket component 104 may include an opening 150 that extends through the bottom wall 140. This opening 150 may be used to receive connector 128 as explained above and shown in FIG. 3. To reduce the amount of material required, the outer limb pocket component 104 may have one or more slots 152, as shown in FIGS. 12, 16, 20-22 and 25. The outer limb pocket component 104 may also comprise a spacer 126 that may extend from the bottom wall 112, as shown. In one embodiment, shown, the opening 150 extends through the spacer 126. As a result, the bow limb portions 22*a*, 22*b* are received on opposite sides of the limb reception channel 116, as shown in FIGS. 22 and 25.

With reference now to FIGS. 19-22, for some embodiments, to ensure a snug fit of the bow limb 22 within the inner and outer limb pocket components 102, 104, a plate 160 may be used. The plate 160 may have a thickness 162 as chosen by a person of skill in the art based on the specific application. The plate 160 may also have any shape chosen by a person of skill in the art. For the embodiment shown, the plate 160 is H-shaped having a mid-section 164. A pair of legs 166, 166 may extend from one side of the mid-section 164 and define opening 168. Opening 168 may receive spacer 120, as shown. Another pair of legs 170, 170 may extend from the other side of the mid-section 164 and define opening 172. Opening 172 may receive inwardly extending portion 132 of back wall 118, as shown. For the embodiment shown, the plate 160 is positioned between the bow limb 22 and the inner limb pocket component 102. However, the plate 160, when used, may be positioned in any manner chosen by a person of skill in the art.

With reference now to FIGS. 1-3, 8-9, 18, 22-24 and 26, to assemble the limb pocket 100 according to one embodiment, the inner limb pocket component 102 may be mounted to the main beam 12. As noted above, that can be accomplished in one embodiment by mounting the inner limb pocket component 102 directly to the main beam 12 and in another embodiment by mounting the inner limb pocket component 102 to the riser 32. In one specific embodiment, boss 38 may be received within hole 122. In another specific embodiment, riser side 36 may be received within slot 136. In yet another embodiment, both the boss 38 and slot 136 may be used.

With reference now to FIGS. 1-3, 7A, 17A and 22-26, once the inner limb pocket component 102 has been mounted to the main beam 12, such as shown in FIGS. 23-24, the proximal end of the bow limb 22 (in some embodiments, the proximal ends of bow limb portions 22*a*, 22*b*) and, if required, the plate 160, may be inserted within the limb reception channel 116. The back wall 118 may be used as a stop to limit the insertion of the bow limb 122 and the plate 160. If bow limb portions 22*a*, 22*b* are used, the spacers 120, 126 and extending portions 132, 148 will assist in keeping the bow limb portions appropriately separated. The outer limb pocket component 104 may then be positioned such that the bow limb 122 is received within the limb reception channel 144 and the key(s) 108 is received within the corresponding groove(s) 110. In one embodiment, when a key 108 is received within a groove 110, the first portion 192 of the groove surface 190 contacts the first portion 182 of the key surface 180 and the second portion 194 of the groove surface 190 contacts the second portion 184 of the key surface 180. In another embodiment, when a key 108 is received within a groove 110, the mid-portion 196 of the groove surface 190 contacts the mid-portion 186 of the key surface 180. In yet another embodiment, when a key 108 is received within a groove 110, the first portion 192 of the groove surface 190 contacts the first portion 182 of the key surface 180, the second portion 194 of the groove surface 190 contacts the second portion 184 of the key surface 180 and, the mid-portion 196 of the groove surface 190 contacts the mid-portion 186 of the key surface 180. In one embodiment, at least a portion of the upper surfaces 188 of walls 114 may contact the upper surfaces 198 of walls 142. In one embodiment, at least a portion of the upper surface of back wall 118 may contact the upper surface of back wall 146 at the same time. The connector 128 may then be inserted through opening 150, through opening 122 and into opening 402 to secure the limb pocket 100 to the riser 32.

With continuing reference to FIGS. 1-3 and 22-26, to assemble the limb pocket 100 according to another embodiment, the inner limb pocket component 102 is mounted to the main beam or the riser as explained above. The connector 128 may then be positioned within openings 150 and 124, but loosely, such as shown in FIG. 21. The proximal end of the bow limb 22 (in some embodiments, the proximal ends of bow limb portions 22*a*, 22*b*) may then be inserted within limb receptions channels 116, 144. If required, the plate 160 may be similarly inserted. In one embodiment, the insertion of the bow limb 22 is completed when the proximal end of the bow limb 22 contacts the inner surfaces of back walls 118, 146. If bow limb portion 22*a*, 22*b* are used, the spacers 120, 126 and extending portions 132, 148 will assist in keeping the bow limb portions appropriately separated. Once the bow limb is properly mounted, the connector 128 can then be tightened.

Still referring to FIGS. 1-3 and 22-26, to assemble the limb pocket 100 according to yet another embodiment, the bow limb 22 may be inserted between the inner limb pocket component 102 and the outer limb pocket component 104. The limb pocket 100 along with the bow limb 122 may then be attached to the riser 32 or the main beam using connector 128 as described above.

With reference now to FIG. 3, when forces F1 and/or F2 are exerted onto the limb pocket 100, the key 108 groove 110 interconnection will prevent relative rotational movement of the inner limb pocket component 102 with respect to the outer limb pocket component 104.

Figure 27:
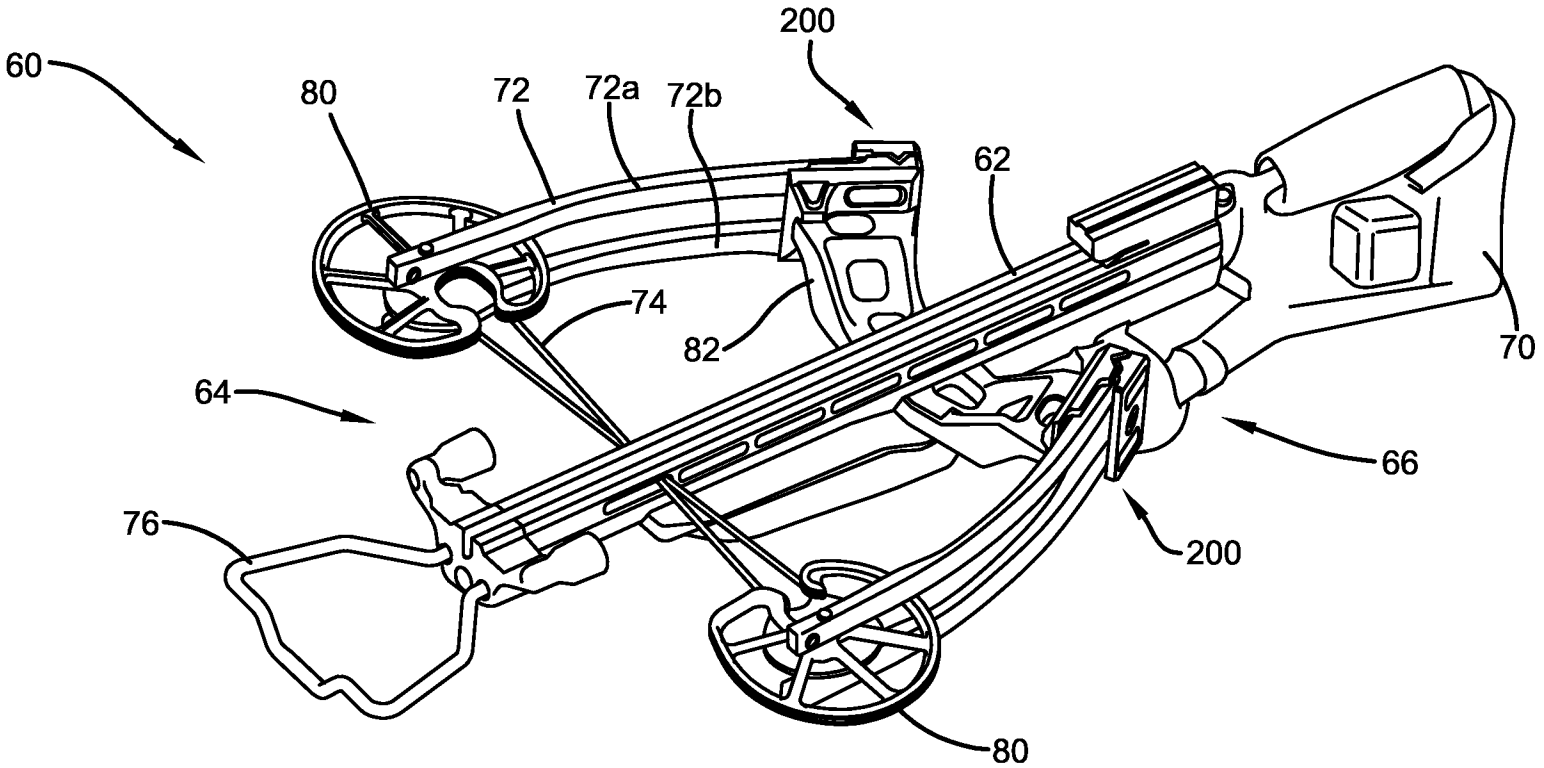
FIG. 27 is a perspective view of a crossbow equipped with a pair of limb pockets according to some embodiments of the invention.
Figure 28:
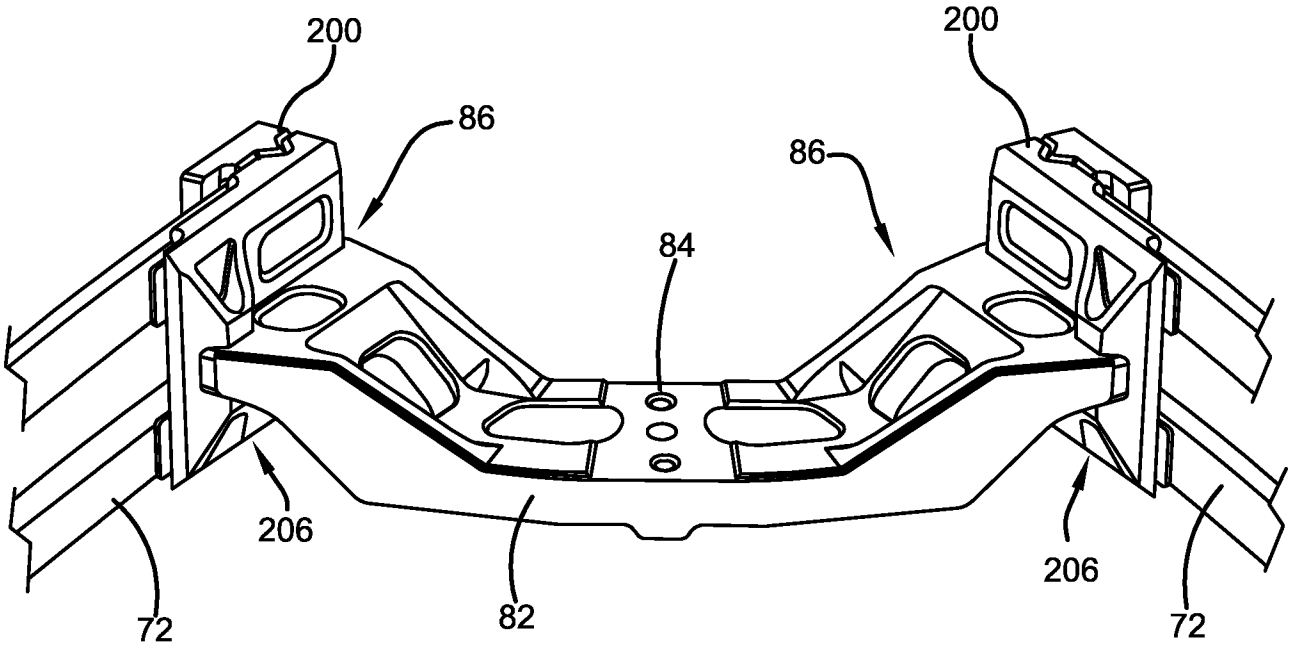
FIG. 28 is an end view of the crossbow riser shown in FIG. 27 with some components removed for clarity.
Figure 29:
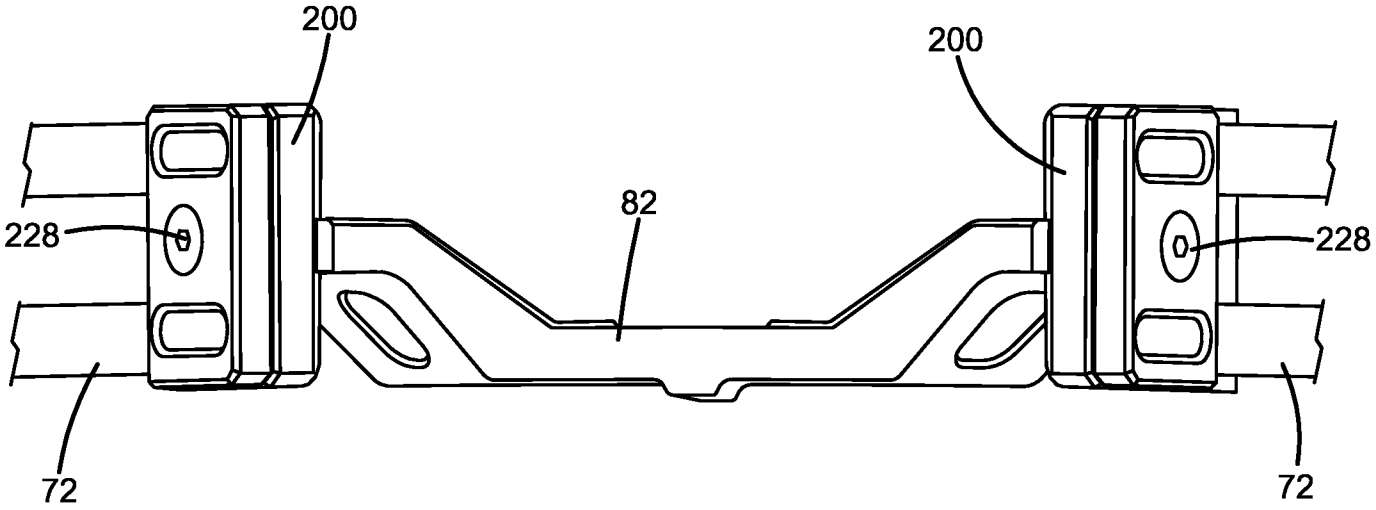
FIG. 29 is an opposite end view of the crossbow riser shown in FIG. 28.

With reference now to FIG. 27, another crossbow 60 may be equipped with a pair of limb pockets 200 according to other embodiments of this invention. The crossbow 60 may include a main beam 62 that extends longitudinally, a bow assembly 64 supported to the main beam 62 and a trigger mechanism 66 supported to the main beam 62. The main beam 62 may support and guide a projectile, such as arrow, not shown, to be fired or shot by the bow assembly 64. The main beam 62 may have a distal end which supports the projectile and a proximal end that includes a shoulder support portion 70 enabling the crossbow 60 to be held by the user when firing the crossbow 60 similar to a rifle. The trigger mechanism 66 may be operable to hold a bowstring 24 in a drawn or cocked condition and operable to release the bowstring 24 out of the drawn condition to fire or propel the projectile (as shown in FIG. 27). The main beam 62 and trigger mechanism 66 may be of any type and style chosen with the sound judgment of a person of skill in the art. The crossbow 12 may include additional components as desired without departing from this invention, but none are required. The crossbow 12 shown, for example, includes a stirrup 76 mounted to the distal end of the main beam 62.

With continuing reference to FIG. 27, the bow assembly 64 may include a pair of bow limbs 72, 72 that extend from opposite sides of the main beam 62 and that receive the bowstring 24. Each bow limb 72 shown is a split limb that comprises first and second portions 72*a*, 72*b* but this invention will work with any type of bow limb chosen with the sound judgment of a person of skill in the art. Wheels and/or cams 80 may be mounted to the distal ends of the bow limbs 72, as shown, making the bow assembly 64 a compound bow but this invention will work with any type of bow assembly chosen with the sound judgment of a person of skill in the art. The proximal ends of the bow limbs 72 may be mounted to respective limb pockets 200 as will be discussed further below. In one embodiment, the limb pockets 200 are supported to the main beam 62 by being mounted directly to the main beam 62. For the embodiment shown, the limb pockets 200 are supported to the main beam 62 by being mounted to a riser 82 that is mounted to the main beam 62. The crossbow shown is known as a reverse draw crossbow because the bow limbs 72, 72 extend distally (from shoulder support 70 and toward stirrup 76) from their proximal ends that are mounted to the main beam 62 to their distal ends that engage the bowstring 24. The limb pockets 200 of this invention, however, may have applicability to other types of crossbows and may have applicability in non-crossbow applications as well.

Figure 30:
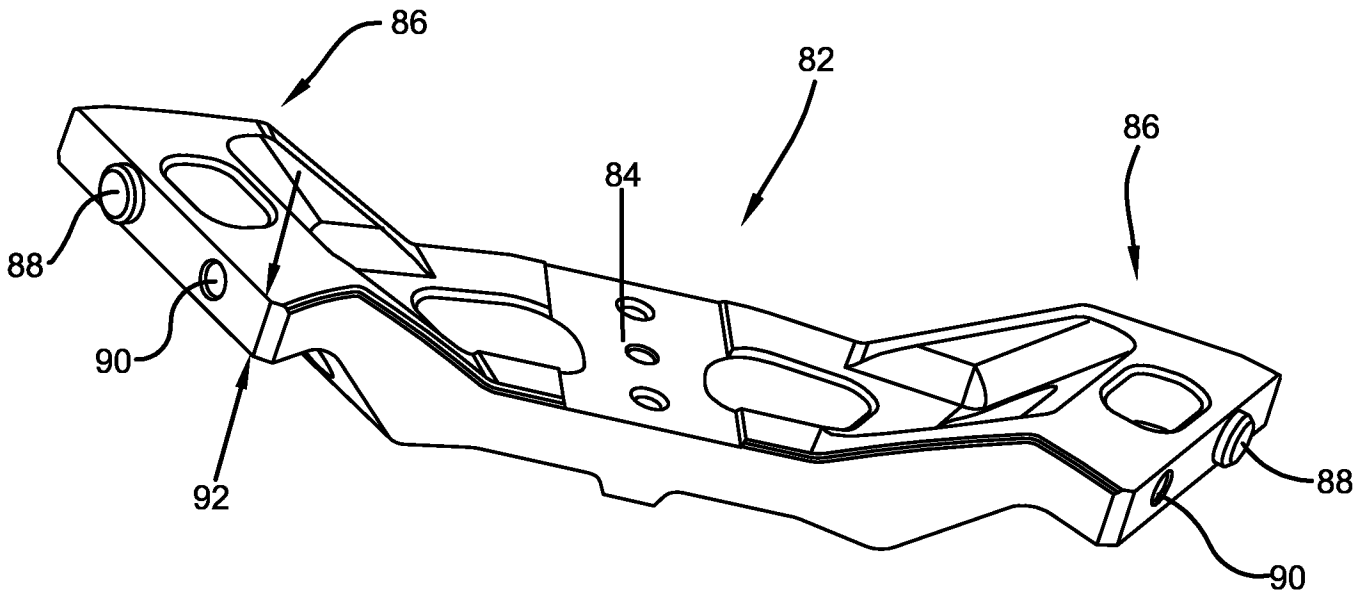
FIG. 30 is a perspective view of a riser according to some embodiments of this invention.
Figure 32:
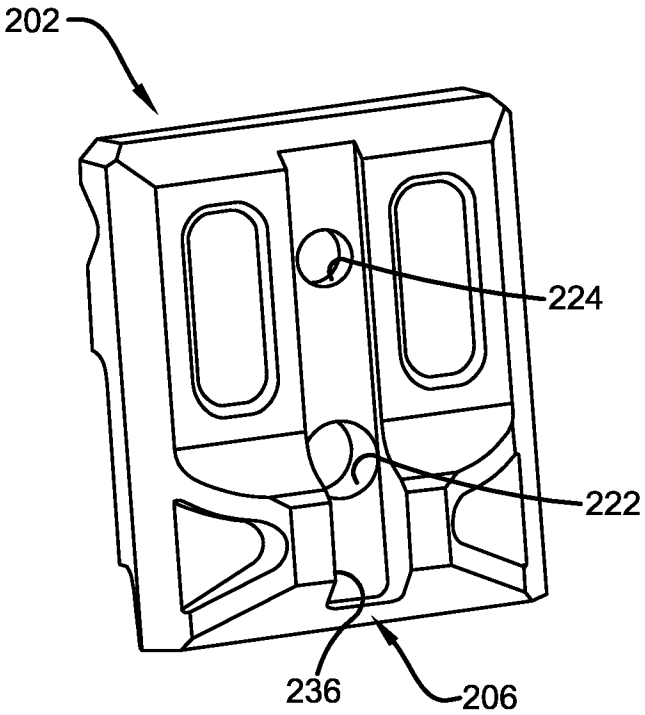
FIG. 32 is a top perspective view of the outer limb pocket component shown in FIG. 31.
Figure 31:
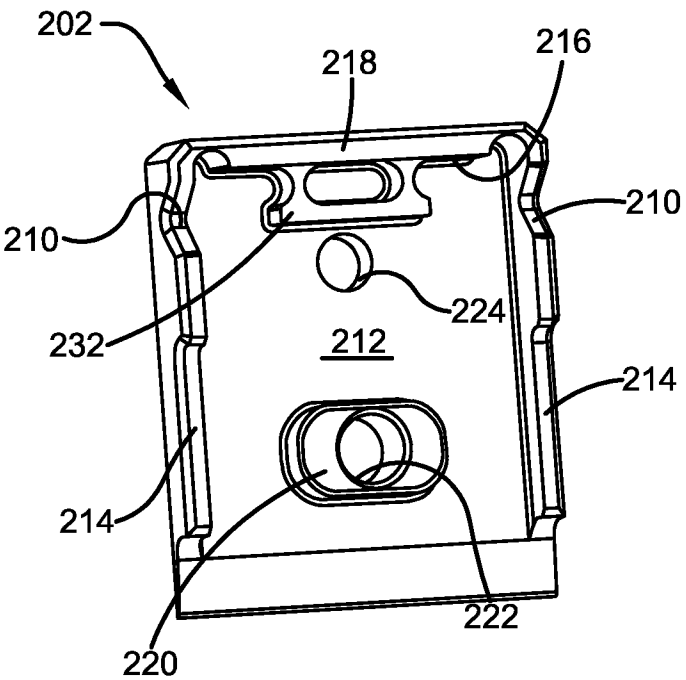
FIG. 31 is a bottom perspective view of an outer limb pocket component according to some embodiments of this invention.
Figure 33:
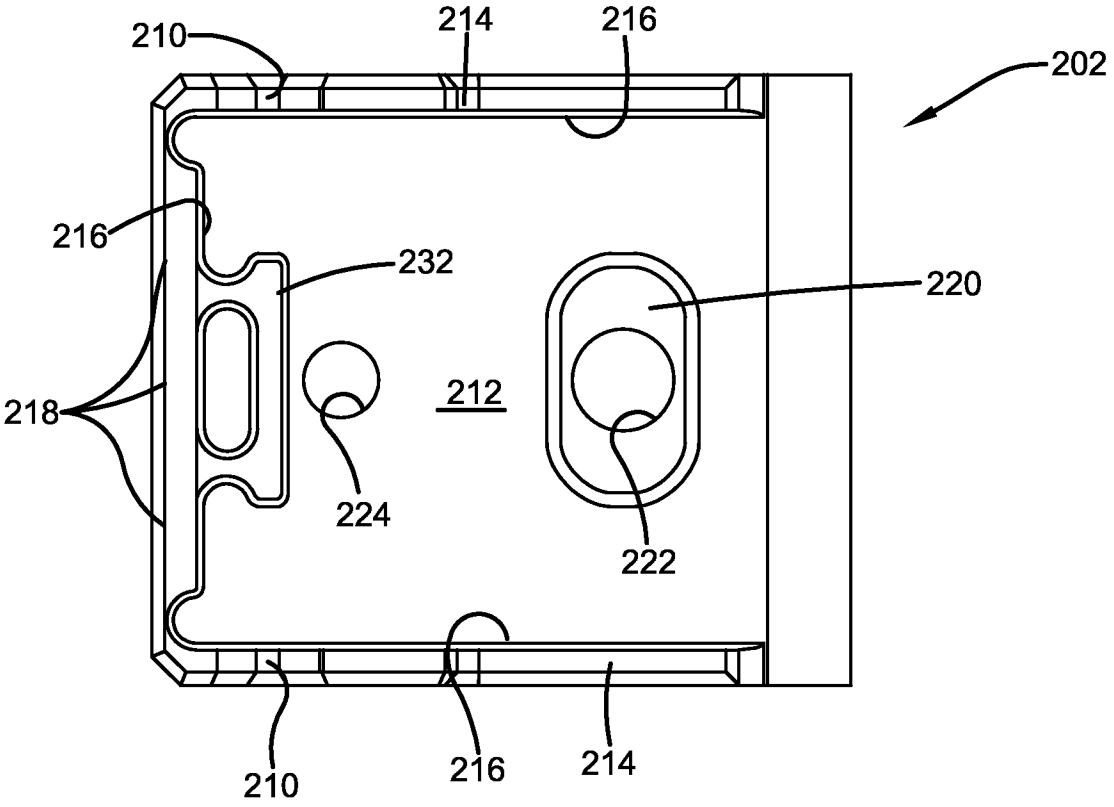
FIG. 33 is a bottom view of the outer limb pocket component shown in FIG. 27.
Figure 34:
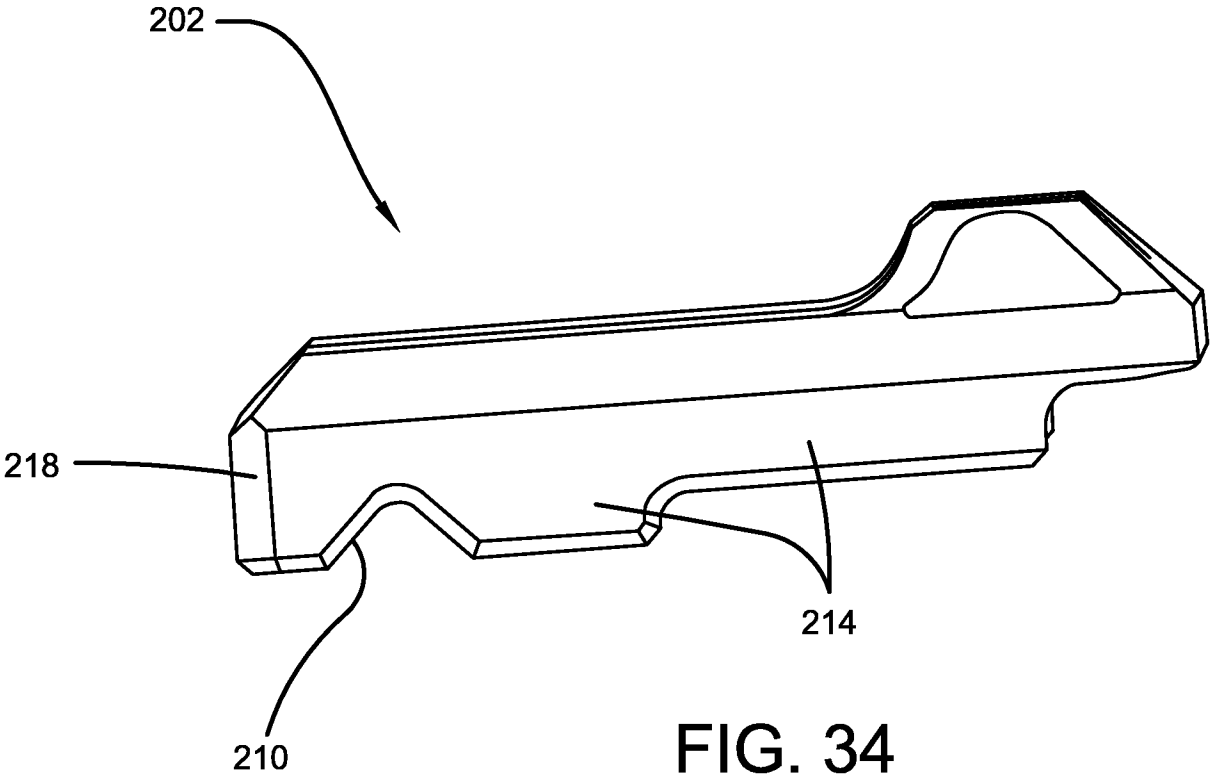
FIG. 34 is a side view of the outer limb pocket component shown in FIG. 27.
Figure 35:
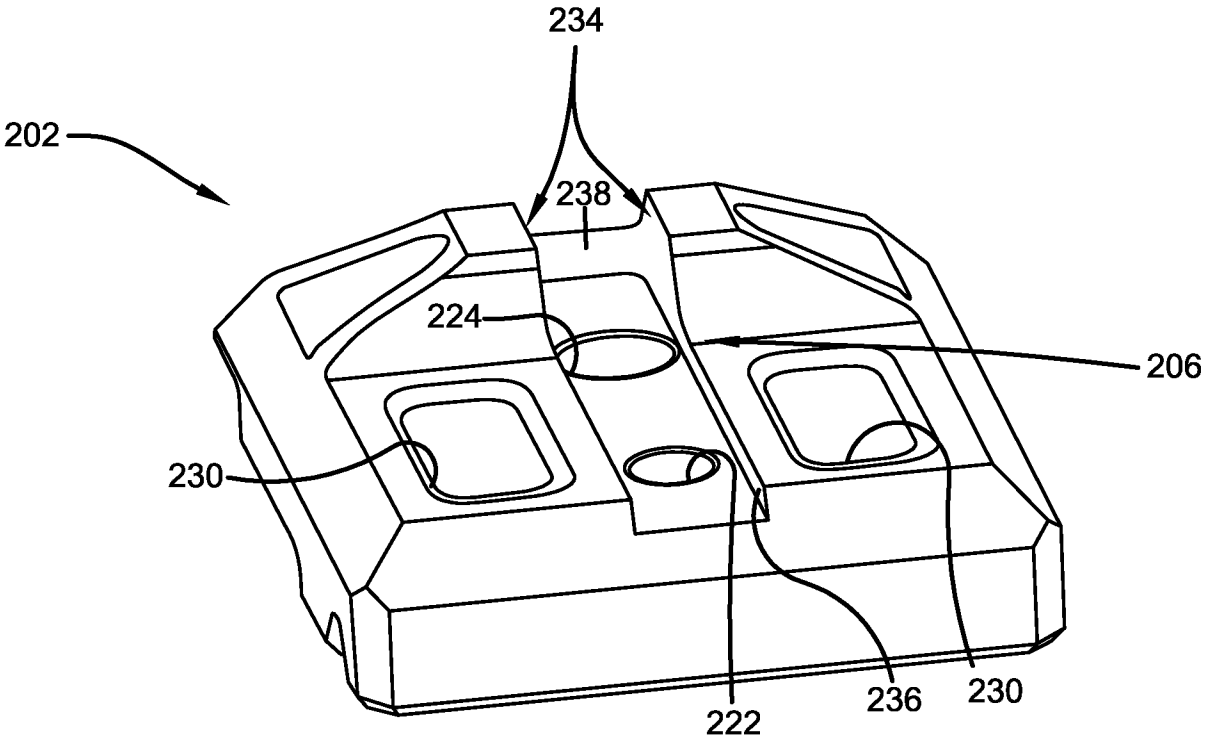
FIG. 35 is a perspective end view of the outer limb pocket component shown in FIG. 27.
Figure 37:
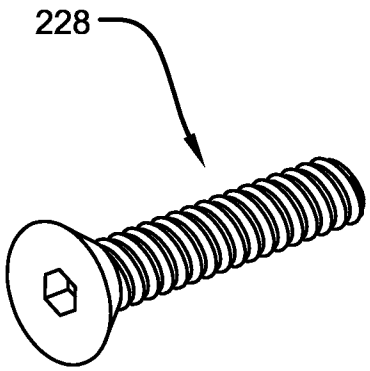
FIG. 37 is a side view of a connector according to some embodiments of this invention.

With reference now to FIGS. 27-30 and 43-44, the crossbow limb pockets 200, 200 are shown mounted to opposite sides of the riser 82. The riser 82 may have a mid-section 84 that is mounted to the main beam 62 in a known manner. The riser 82 may also have first and second sides 86, 86 that are positioned on opposite sides of the main beam 62 when the riser 82 is attached to the main beam 62. Each side 86 may include, as shown in FIG. 30, a boss 88 that extends outwardly from the riser and an opening 90. Each boss 88 may have any shape or size chosen with the sound judgment of a person of skill in the art. For the embodiment shown, each a boss 88 has a circular cross-section. Each side 86 of the riser 82 may also have a thickness 92. The purposes and use of the boss 88, opening 90 and thickness 92 will be discussed below.

Figure 41:
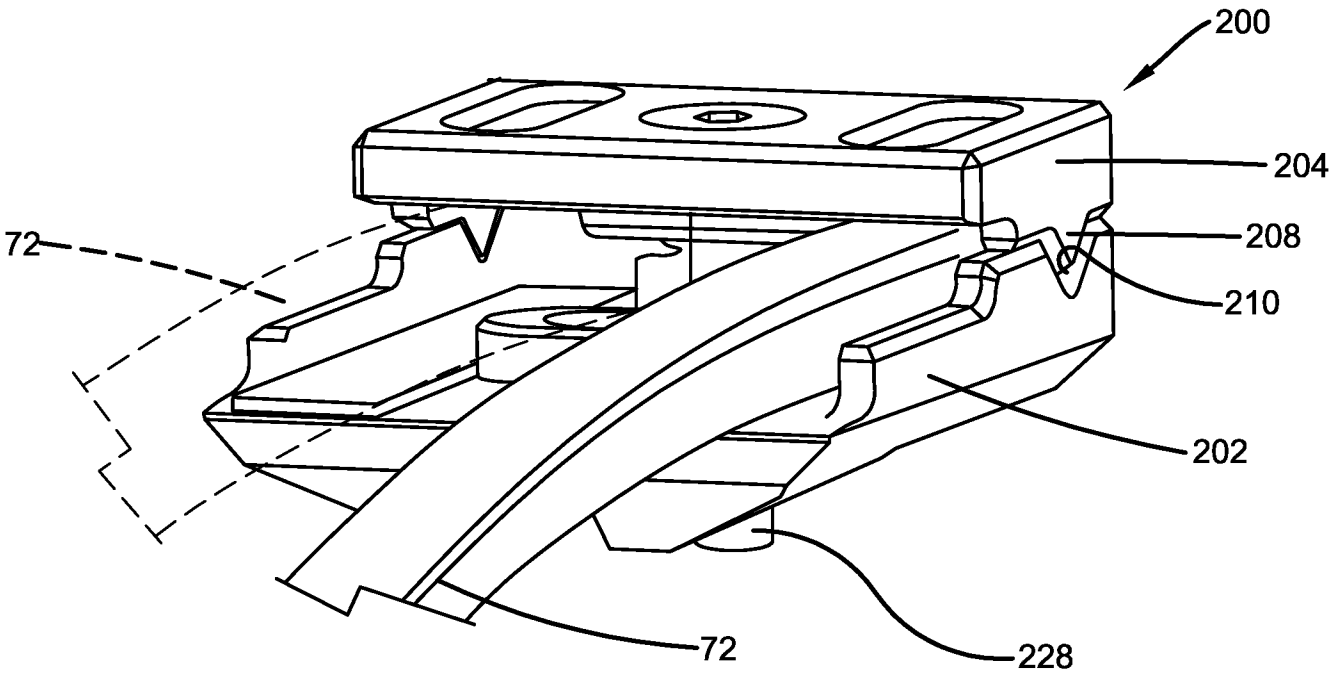
FIG. 41 is an end perspective view of a portion of a limb pocket according to some embodiments of this invention with a portion of the bow limb shown as being transparent.
Figure 42:
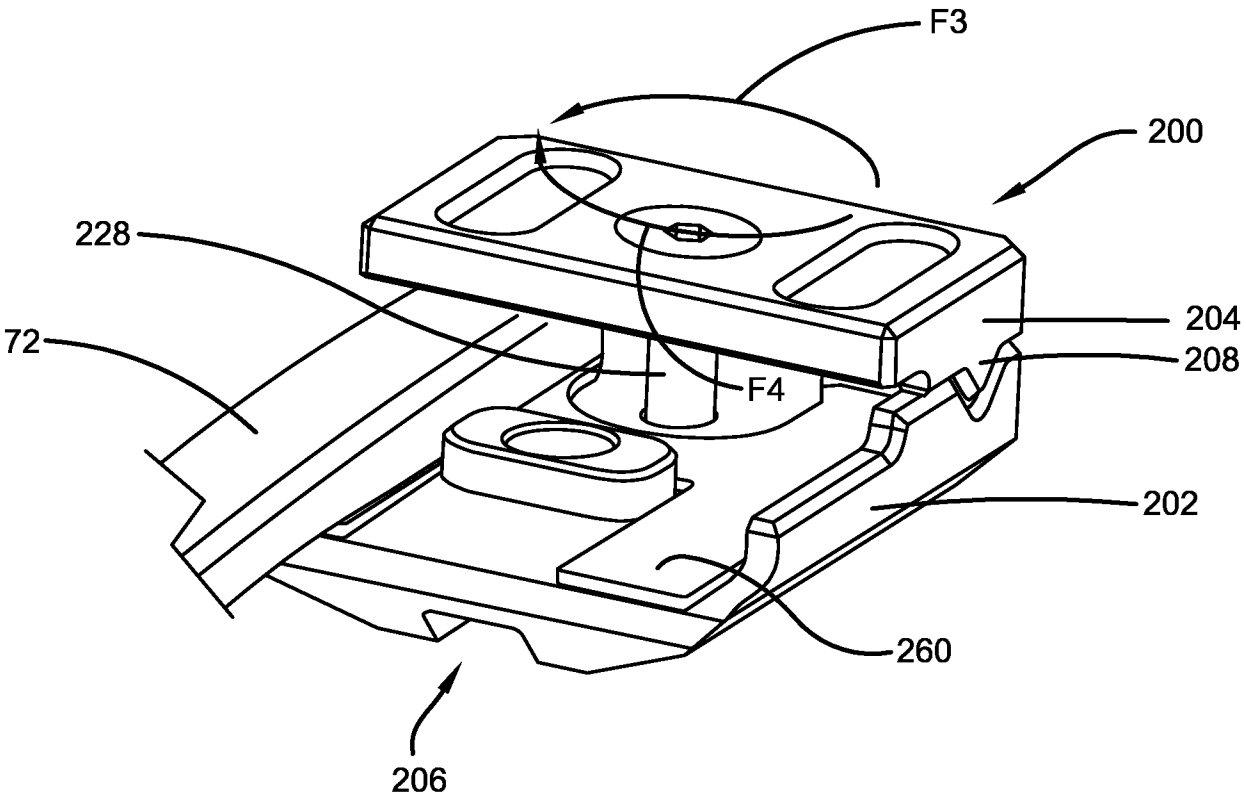
FIG. 42 is an end perspective view of a portion of a limb pocket similar to that sown in FIG. 41 but from a different angle.

With reference now to FIGS. 27-29, 41-44, each limb pocket 200 may include an inner limb pocket component 202 and an outer limb pocket component 204. Because each limb pocket 200 may be made of the same components, the description to follow may apply to as many limb pockets as may be used (one or more). FIGS. 41-44 show close-up views of a limb pocket 200 receiving the proximal end of bow limb 72 which, in one non-limiting embodiment, may be a split limb comprising first and second portions 72*a*, 72*b* as referenced in FIG. 27. When the bowstring is drawn and released, forces F3, F4 shown in FIG. 42 are created and applied to the limb pocket 200. These forces F3, F4, similar to forces F1 and F2 discussed above, are detrimental as they may cause a reduction in power to the projectile. They may also cause the inner limb pocket component 202 to rotate with respect to the outer limb pocket component 204. To resist these forces F3, F4 and prevent this relative rotational movement between inner limb pocket component 202 and outer limb pocket component 204, at least one key 208 (such as shown in FIGS. 38-44) on one component may be received in at least one groove 210 (such as shown in FIGS. 31, 33-34 and 41-44) in the other component. The terms "key" and "groove" were described above. It should be noted that while forces F3 and F4 may be centered on the longitudinal axis of connector 228, this invention will also resist other forces as is understood by a person of skill in the art. The keys 208 and grooves 210 may be shaped and sized similar to the previously described keys 108 and grooves 110.

Figure 43:
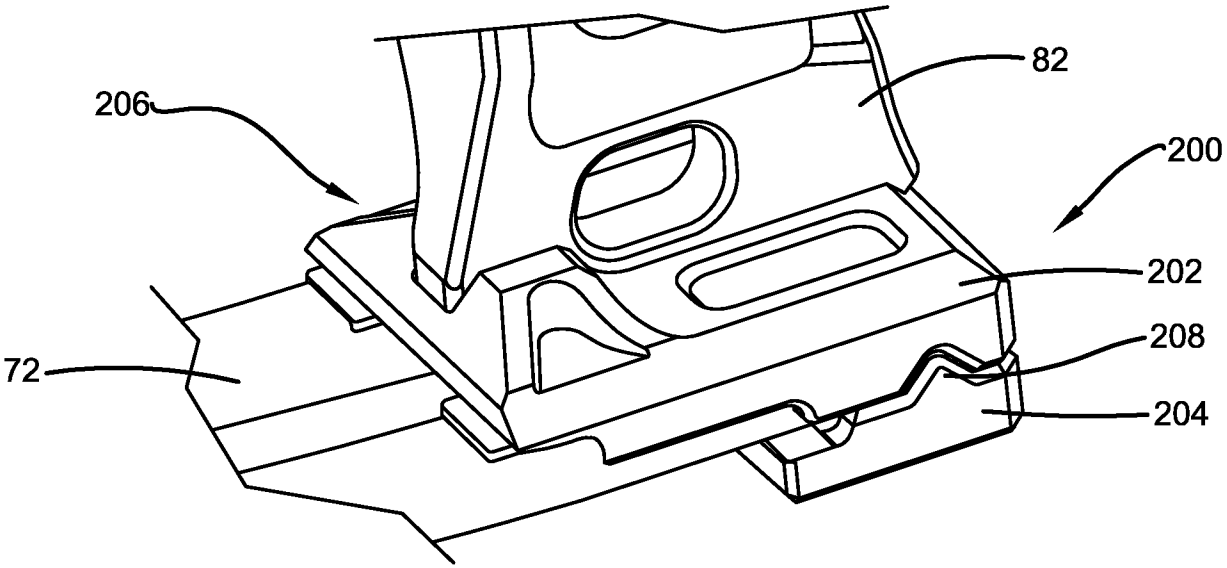
FIG. 43 is a top perspective view of a riser connected to the inner limb pocket component according to some embodiments of this invention.
Figure 44:
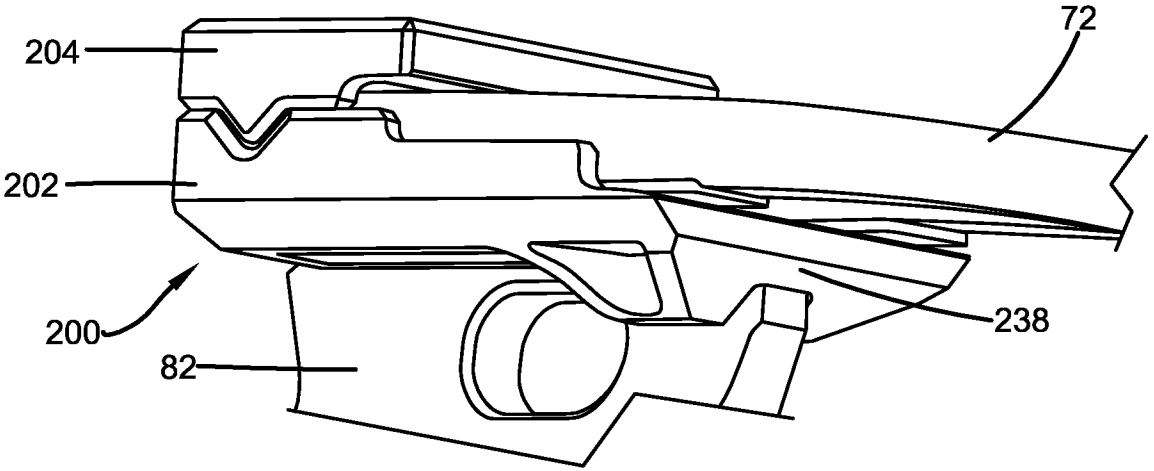
FIG. 44 is a side perspective view of a riser connected to the inner limb pocket component according to some embodiments of this invention.

With reference now to FIGS. 27-29, 32, 35 and 43-44, each inner limb pocket component 202 may include a support surface 206 that mounts the inner limb pocket component 202, and thus the limb pocket 200, to the crossbow. For the embodiment shown, the support surfaces 206, 206, mount the respective limb pockets 200, 200 to opposite sides 86, 86 of the riser 82. In one embodiment, one of the riser side 86 and the support surface 206 comprises a boss and the other comprises a hole that receives the boss to connect that side of the riser to the support surface 206 of the inner limb pocket component 202. For the embodiment shown, each riser side 86 comprises a boss 88 that is received in a hole 222 formed in the support surface 206. Hole 222 may extend through inner limb pocket component 202, as shown. FIGS. 43-44 show one side of the riser 82 connected to the support surface 206 of the inner limb pocket component 202. In another embodiment, not shown, the boss extends from the support surface 206 and the hole is formed in the side 86 of the riser 82.

With continuing reference to FIGS. 27-29, 32, 35 and 43-44, in another embodiment each support surface 206 comprises a slot 236. The slot 236 may receive the corresponding side 86 of the riser 82 to connect support surface 206 to the riser side 86. Thus, the thickness 92 of the riser 86 shown in FIG. 30, is less than or equal to the width of the slot 236. In one specific embodiment, shown and referenced in FIGS. 35 and 44, an end extension 238 is positioned at one end of the slot 236 to form a stop which limits how far the riser side 86 can be inserted within the slot 236. In another embodiment, the walls that define the slot 86 may be higher at one end of the slot 86, as shown at locations 234. In one specific embodiment, the higher walls are positioned at the end of the slot 86 where the end extension 238 is positioned. FIGS. 43-44 shows one side of the riser 82 connected to the support surface 206 of the inner limb pocket component 202.

With reference now to FIGS. 28-29, 31-35 and 41-44, the inner limb pocket component 202 may include a bottom wall 212 and a pair of side walls 214, 214 that extend from the bottom wall 212. These walls 212, 214, 214 may define a limb reception channel 216 that receives an end of the bow limb 72, as shown in FIGS. 41-44. The inner limb pocket component 202 may also include a back wall 218 that may also define the limb reception channel 218. At least one groove 210, two shown, may be formed on the inner limb pocket component 202. For the embodiment shown, each groove 210 is formed on a side wall 214. With this arrangement, the grooves 210, 210 are positioned on opposite sides of the limb reception channel 216 and thus on opposite sides of the bow limb 72. The grooves 210, 210 may be collinear along a line that is substantially perpendicular to the longitudinal axis of the inner limb pocket component 202 and the bow limb 72, as shown. While each groove 210 may have any size and shape chosen with the sound judgment of a person of skill in the art, for the embodiments shown, each groove 210 has a V-shape. In one non-limiting embodiment, each groove 210 is sized the same as previously described groove 110.

With continuing reference to FIGS. 28-29, 31-35 and 41-44, the inner limb pocket component 202 may also comprise a spacer 220 that may extend from the bottom wall 212, as shown. For the embodiment shown, spacer 220 may extend from wall 212. The spacer 220 may be used, as shown in FIGS. 41-42, to maintain separation between the bow limb portions 72*a*, 72*b* (referenced in FIG. 27) by extending between the bow limb portions 72*a*, 72*b*. As a result, the bow limb portions 72*a*, 72*b* are received on opposite sides of the limb reception channels 216. In one embodiment, the back wall 218 may include an inwardly extending portion 232 that also maintains the separation between the bow limb portions. The inner limb pocket component 202 may include an opening 224 that extends through the bottom wall 212. Previously described hole 222 may extend, as shown, through spacer 220. This minimizes the required material and therefore lightens the component mass and may provide additional surface area for the boss 88 to contact. Opening 224 may receive a connector 228 (see FIGS. 29, 37 and 41-42) to mount the outer limb pocket component 204 to the inner limb pocket component 202. In one embodiment, shown, connector 228 also extends into the opening 90 formed on the side 86 of the riser 82 where it may be attached to the riser 82 and thus to the main beam 62 such as with engaging threads. To reduce the amount of material required, the inner limb pocket component 202 may have one or more slots 230, as referenced in FIG. 35.

With reference now to FIGS. 28-29, 36 and 38-42, the outer limb pocket component 204 may include a bottom wall 240 and a pair of side walls 242 that extend from the bottom wall 240. These walls 240, 242, 242 may define a limb reception channel 244 that receives an end of the bow limb 72. The outer limb pocket component 204 may also include a back wall 246 that may also define the limb reception channel 244. In one embodiment, the back wall 246 may include an inwardly extending portion 248 that maintains the separation between the bow limb portions 72*a*, 72*b*. At least one key 208, two shown, may be formed on the outer limb pocket component 204. For the embodiment shown, each key 208 is formed in a side wall 242. With this arrangement, the keys 208, 208 are positioned on opposite sides of the limb reception channel 244 and thus on opposite sides of the bow limb 72. The keys 208, 208 may be collinear along a line that is substantially perpendicular to the longitudinal axis of the outer limb pocket component 204 and the bow limb 72, as shown. While each groove 210 may have any size and shape chosen with the sound judgment of a person of skill in the art, for the embodiments shown (see FIGS. 38 and 40), each key 208 has a V-shape with a height, width and length that matches the depth, width and length of each corresponding groove 210. For the embodiment shown, groove length is substantially the same as the thickness of side wall 242.

Figure 36:
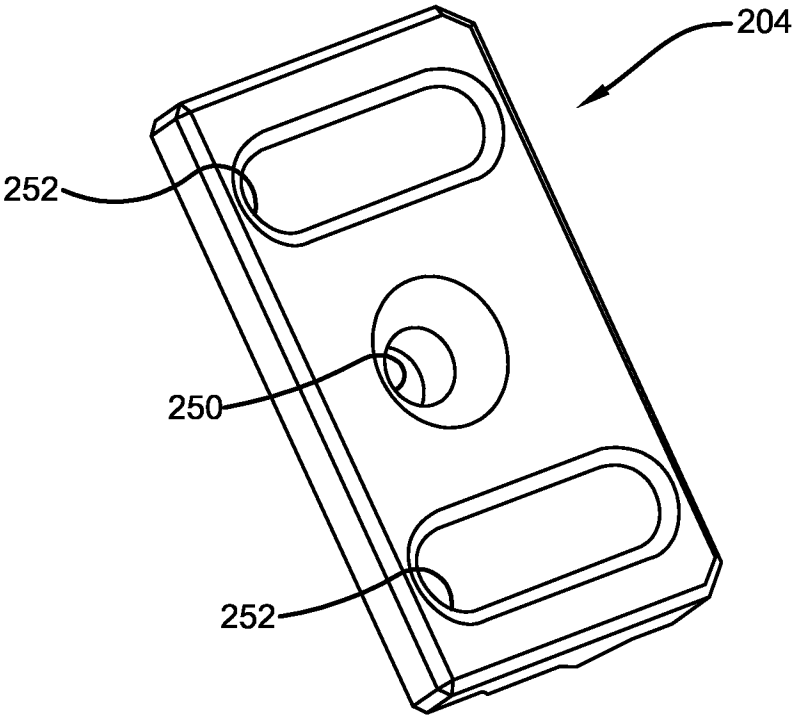
FIG. 36 is a top perspective view of the inner limb pocket component shown in FIG. 27.
Figure 38:
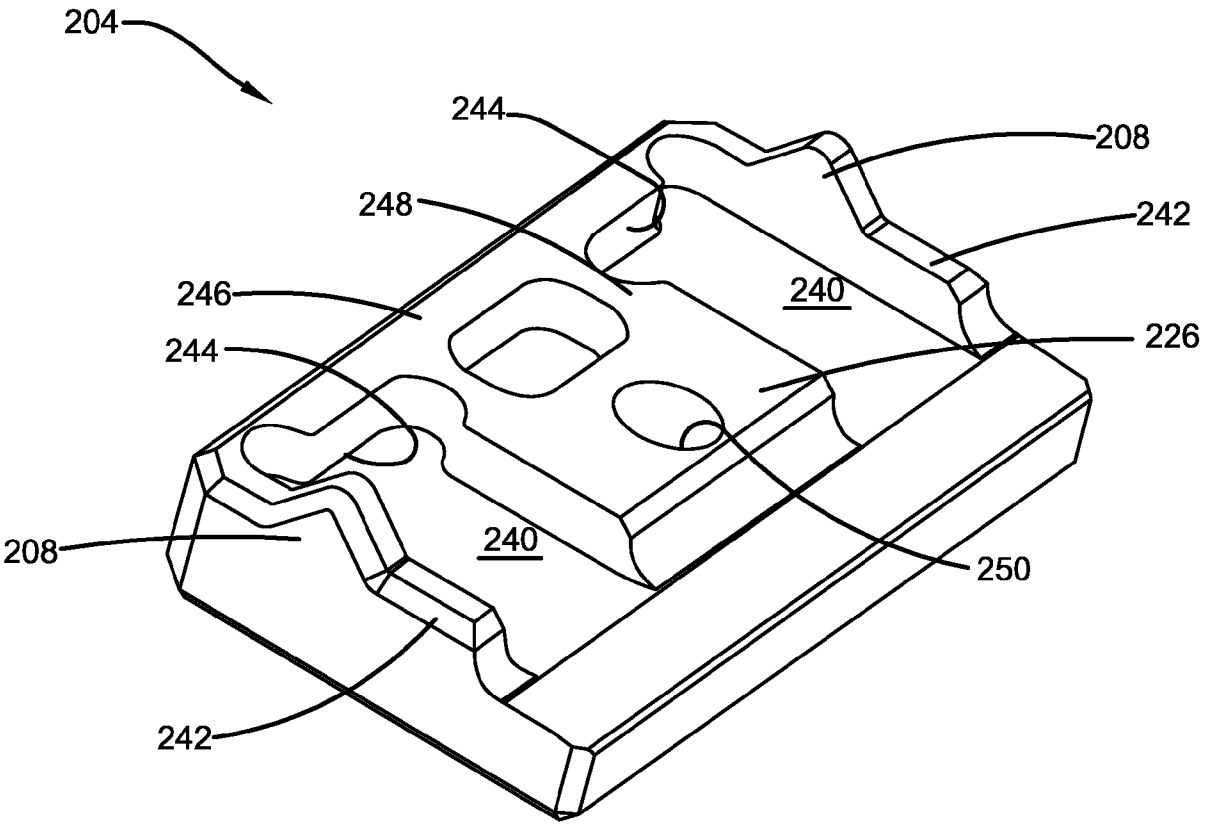
FIG. 38 is a bottom perspective view of the inner limb pocket component shown in FIG. 27.
Figure 39:
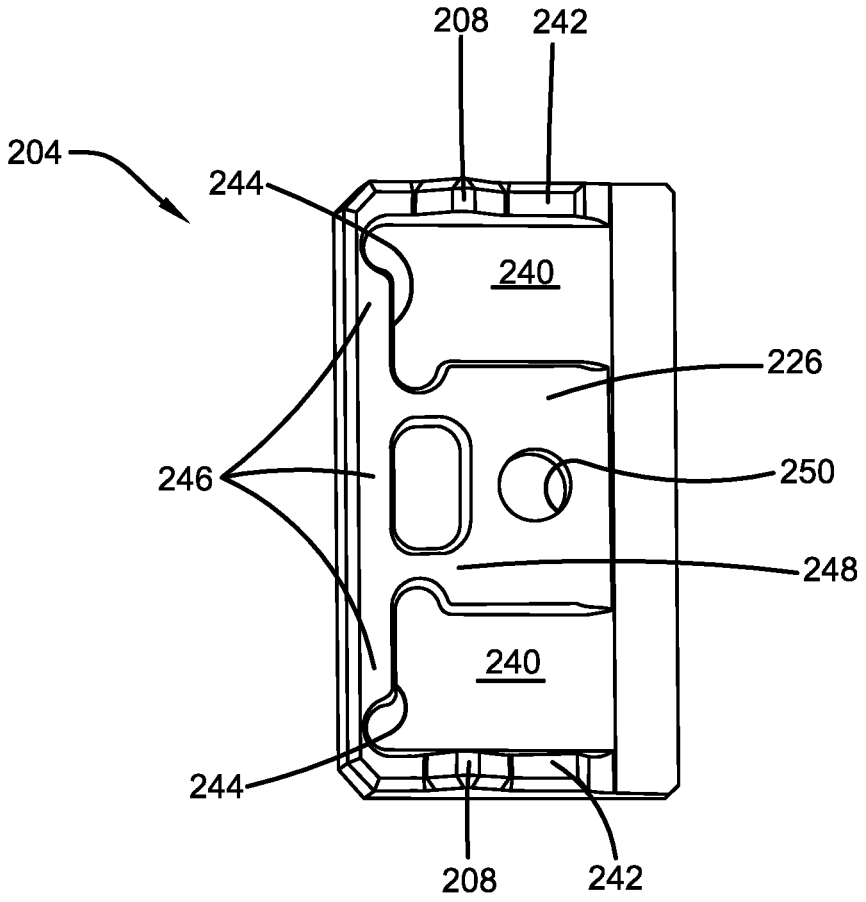
FIG. 39 is a bottom view of the inner limb pocket component shown in FIG. 38.
Figure 40:
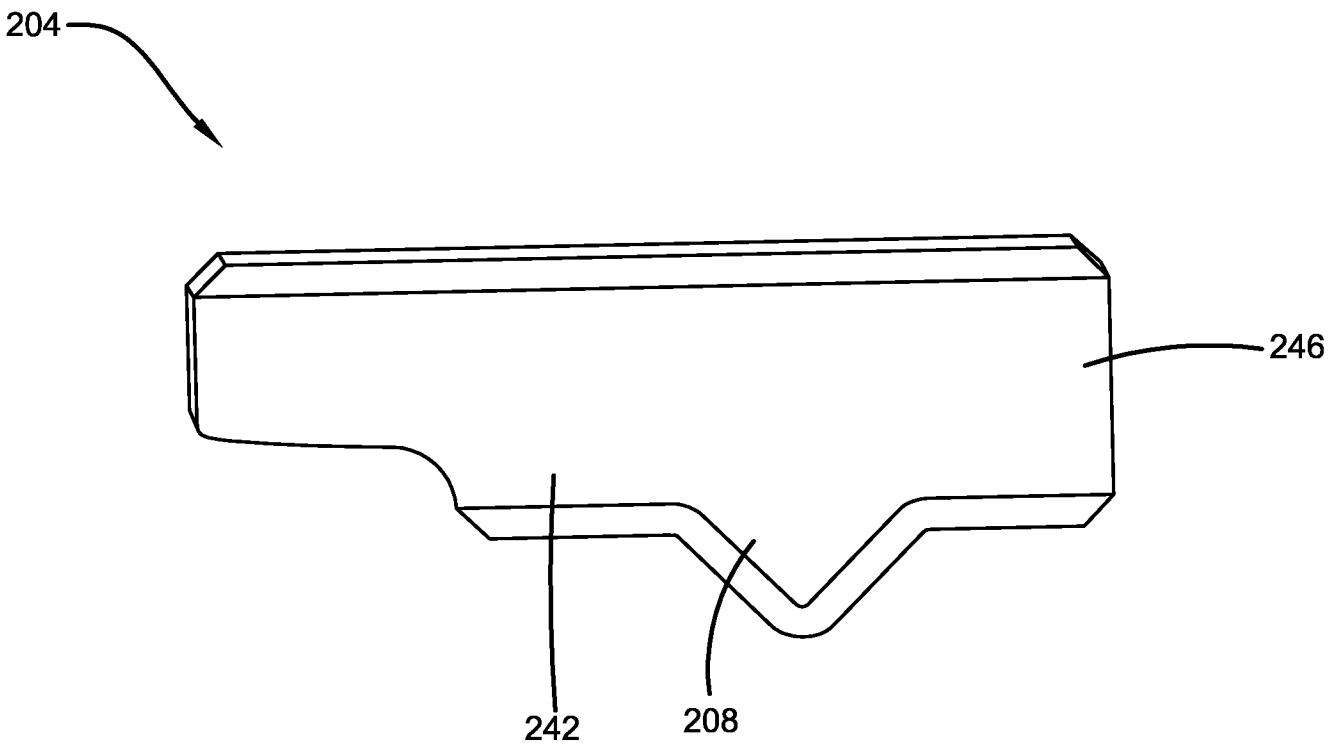
FIG. 40 is an end view of the inner limb pocket component shown in FIG. 38.

With continuing reference to FIGS. 28-29, 36 and 38-42, the outer limb pocket component 204 may include an opening 250 that extends through the bottom wall 240. This opening 250 may be used to receive connector 228 as explained above and shown in FIGS. 29 and 41-42. To reduce the amount of material required, the outer limb pocket component 204 may have one or more slots 252, as shown in FIG. 36. The outer limb pocket component 204 may also comprise a spacer 226 that may extend from the bottom wall 240, as shown. In one embodiment, shown, the opening 250 extends through the spacer 226. As a result, the bow limb portions 72*a*, 72*b* are received on opposite sides of the limb reception channels 216, 218.

With reference now to FIGS. 41-42, for some embodiments, to ensure a snug fit of the bow limb 72 within the inner and outer limb pocket components 202, 204, a plate 260 may be used. The plate 260 may be similar to previously described plate 160 so further details will not be provided here. The limb pocket 200 may be assembled similarly as with previously described limb pocket 100.

It should be noted that numerous design variations may be made and still fall under the protection of this patent. While two keys 208 and two corresponding grooves 210 have been discussed, only one key and one groove 210 may be used as may three or more. Also, as described above, one or more keys 208 may be on either the inner or outer limb pocket component 202, 204 while one or more grooves 210 may be on the other of the inner or outer limb pocket component 204, 202. In yet another embodiment, the inner limb pocket component 202 may have at least one key and at least one groove that engage corresponding at least one groove and at least one key on the outer limb pocket component 204.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof. Further, the "invention" as that term is used in this document is what is claimed in the claims of this document. The right to claim elements and/or sub-combinations that are disclosed herein as other inventions in other patent documents is hereby unconditionally reserved.

We claim:

1. A crossbow comprising:

a main beam that is adapted to guide an associated projectile;

a riser supported to the main beam and comprising first and second sides positioned on opposite sides of the main beam;

a bow assembly supported to the riser and comprising: (1) a first bow limb having a first end and a second end that receives a bowstring; and, (2) a second bow limb having a first end and a second end that receives the bowstring;

a trigger mechanism that: (1) is supported to the main beam; and, (2) is operable to release the bowstring to propel the associated projectile away from the main beam; and, (A) a first limb pocket comprising:

an inner limb pocket component that comprises: (1) a support surface that mounts the inner limb pocket component to the first side of the riser; (2) a bottom wall; and, (3) first and second side walls that extend from the bottom wall; wherein the walls of the inner limb pocket component define a first limb reception channel that receives the first end of the first bow limb;

an outer limb pocket component that comprises: (1) a bottom wall; and, (2) first and second side walls that extend from the bottom wall; wherein the walls of the outer limb pocket component define a second limb reception channel that receives the first end of the first bow limb;

a first connector that connects the outer limb pocket component to the inner limb pocket component to hold the first end of the first bow limb within the first and second limb reception channels;

wherein a first groove is formed in one of the first side wall of the inner limb pocket component and the first side wall of the outer limb pocket component;

wherein the first groove is defined by a first groove surface that has a first portion, a second portion and a mid-portion that: (1) is positioned between the first and second portions; and, (2) extends inwardly farther than the first and second portions;

wherein a first key is formed on the other of the first side wall of the inner limb pocket component and the first side wall of the inner limb pocket component;

wherein the first key is defined by a first key surface that has a first portion, a second portion and a mid-portion that: (1) is positioned between the first and second portions; and, (2) extends outwardly farther than the first and second portions;

wherein a second groove is formed in one of the second side wall of the inner limb pocket component and the second side wall of the outer limb pocket component;

wherein the second groove is defined by a second groove surface that has a first portion, a second portion and a mid-portion that: (1) is positioned between the first and second portions; and, (2) extends inwardly farther than the first and second portions;

wherein a second key is formed on the other of the second side wall of the inner limb pocket component and the second side wall of the outer limb pocket component;

wherein the second key is defined by a second key surface that has a first portion, a second portion and a mid-portion that: (1) is positioned between the first and second portions; and, (2) extends outwardly farther than the first and second portions;

wherein the first key is received within the first groove when the inner limb pocket component is connected to the outer limb pocket component;

wherein the second key is received within the second groove when the inner limb pocket component is connected to the outer limb pocket component; and, wherein when the first key is received within the first groove and the second key is received within the second groove relative rotational movement of the inner limb pocket component with respect to the outer limb pocket component is prevented;

(B) a second limb pocket comprising:

an inner limb pocket component that comprises: (1) a support surface that mounts the inner limb pocket component to the second side of the riser; (2) a bottom wall; and, (3) first and second side walls that extend from the bottom wall; wherein the walls of the inner limb pocket component define a first limb reception channel that receives the first end of the second bow limb;

an outer limb pocket component that comprises: (1) a bottom wall; and, (2) first and second side walls that extend from the bottom wall; wherein the walls of the outer limb pocket component define a second limb reception channel that receives the first end of the second bow limb;

a second connector that connects the outer limb pocket component to the inner limb pocket component to hold the first end of the second bow limb within the first and second limb reception channels;

wherein a first groove is formed in one of the first side wall of the inner limb pocket component and the first side wall of the outer limb pocket component;

wherein the first groove is defined by a first groove surface that has a first portion, a second portion and a mid-portion that: (1) is positioned between the first and second portions; and, (2) extends inwardly farther than the first and second portions;

wherein a first key is formed on the other of the first side wall of the inner limb pocket component and the first side wall of the inner limb pocket component;

wherein the first key is defined by a first key surface that has a first portion, a second portion and a mid-portion that: (1) is positioned between the first and second portions; and, (2) extends outwardly farther than the first and second portions;

wherein a second groove is formed in one of the second side wall of the inner limb pocket component and the second side wall of the outer limb pocket component;

wherein the second groove is defined by a second groove surface that has a first portion, a second portion and a mid-portion that: (1) is positioned between the first and second portions; and, (2) extends inwardly farther than the first and second portions;

wherein a second key is formed on the other of the second side wall of the inner limb pocket component and the second side wall of the outer limb pocket component;

wherein the second key is defined by a second key surface that has a first portion, a second portion and a mid-portion that: (1) is positioned between the first and second portions; and, (2) extends outwardly farther than the first and second portions;

wherein the first key is received within the first groove when the inner limb pocket component is connected to the outer limb pocket component;

wherein the second key is received within the second groove when the inner limb pocket component is connected to the outer limb pocket component; and, wherein when the first key is received within the first groove and the second key is received within the second groove relative rotational movement of the inner limb pocket component with respect to the outer limb pocket component is prevented.

2. The crossbow of claim 1 wherein:

the support surface of the inner limb pocket component of the first limb pocket comprises a slot that receives the first side of the riser to connect the first side of the riser to the support surface of the inner limb pocket component of the first limb pocket; and, the support surface of the inner limb pocket component of the second limb pocket comprises a slot that receives the second side of the riser to connect the second side of the riser to the support surface of the inner limb pocket component of the second limb pocket.

3. The crossbow of claim 1 wherein:

the crossbow is a reverse draw crossbow.

4. The crossbow of claim 1 wherein:

for the first limb pocket, when the first key is received within the first groove and the second key is received within the second groove:

the first portion of the first groove surface contacts the first portion of the first key surface;

the second portion of the first groove surface contacts the second portion of the first key surface;

the first portion of the second groove surface contacts the first portion of the second key surface; and, the second portion of the second groove surface contacts the second portion of the second key surface; and, for the second limb pocket, when the first key is received within the first groove and the second key is received within the second groove:

the first portion of the first groove surface contacts the first portion of the first key surface;

the second portion of the first groove surface contacts the second portion of the first key surface;

the first portion of the second groove surface contacts the first portion of the second key surface; and, the second portion of the second groove surface contacts the second portion of the second key surface.

5. The crossbow of claim 4 wherein:

for the first limb pocket, when the first key is received within the first groove and the second key is received within the second groove:

the mid-portion of the first groove surface contacts the mid-portion of the first key surface; and, the mid-portion of the second groove surface contacts the mid-portion of the second key surface; and, for the second limb pocket, when the first key is received within the first groove and the second key is received within the second groove:

the mid-portion of the first groove surface contacts the mid-portion of the first key surface; and, the mid-portion of the second groove surface contacts the mid-portion of the second key surface.

6. The crossbow of claim 1 wherein:

for the first limb pocket:

the wall that the first groove is formed in has a first groove wall thickness and the first groove has a first groove length that is substantially the same as the first groove wall thickness;

the wall that the first key is formed on has a first key wall thickness and the first key has a first key length that is substantially the same as the first key wall thickness;

the wall that the second groove is formed in has a second groove wall thickness and the second groove has a second groove length that is substantially the same as the second groove wall thickness; and, the wall that the second key is formed on has a second key wall thickness and the second key has a second key length that is substantially the same as the second key wall thickness; and, for the second limb pocket:

the wall that the first groove is formed in has a first groove wall thickness and the first groove has a first groove length that is substantially the same as the first groove wall thickness;

the wall that the first key is formed on has a first key wall thickness and the first key has a first key length that is substantially the same as the first key wall thickness;

the wall that the second groove is formed in has a second groove wall thickness and the second groove has a second groove length that is substantially the same as the second groove wall thickness; and, the wall that the second key is formed on has a second key wall thickness and the second key has a second key length that is substantially the same as the second key wall thickness.

7. The crossbow of claim 1 wherein:

for the first limb pocket:

the first groove is substantially V-shaped;

the first key is substantially V-shaped;

the second groove is substantially V-shaped; and, the second key is substantially V-shaped; and, for the second limb pocket:

the first groove is substantially V-shaped;

the first key is substantially V-shaped;

the second groove is substantially V-shaped; and, the second key is substantially V-shaped.

8. The crossbow of claim 1 wherein:

for the first limb pocket:

the inner limb pocket component has a connector opening that receives the connector; and, when the inner limb pocket component is connected to the outer limb pocket component, a line that intersects the mid-portion of the first key surface and the mid-portion of the second key surface does not intersect the connector opening; and, for the second limb pocket:

the inner limb pocket component has a connector opening that receives the connector; and, when the inner limb pocket component is connected to the outer limb pocket component, a line that intersects the mid-portion of the first key surface and the mid-portion of the second key surface does not intersect the connector opening.

9. The crossbow of claim 1 wherein:

the first bow limb has a first longitudinal axis;

the second bow limb has a second longitudinal axis;

for the first limb pocket: when the inner limb pocket component is connected to the outer limb pocket component, a line that intersects the mid-portion of the first key surface and the mid-portion of the second key is substantially perpendicular to the first bow limb's longitudinal axis; and, for the second limb pocket: when the inner limb pocket component is connected to the outer limb pocket component, a line that intersects the mid-portion of the first key surface and the mid-portion of the second key is substantially perpendicular to the first bow limb's longitudinal axis.

10. The crossbow of claim 1 wherein:

(A) for the first limb pocket:

the first bow limb comprises first and second portions;

at least one of the inner and outer limb pocket components comprises a first spacer;

the first bow limb portion is received within a first side of the first and second limb reception channels;

the second bow limb portion is received within a second side of the first and second limb reception channels; and, the first spacer extends between the first and second bow limb portions;

(B) for the second limb pocket:

the second bow limb comprises first and second portions;

at least one of the inner and outer limb pocket components comprises a first spacer;

the first bow limb portion is received within a first side of the first and second limb reception channels;

the second bow limb portion is received within a second side of the first and second limb reception channels; and, the first spacer extends between the first and second bow limb portions.

11. A crossbow limb pocket for use in mounting an associated bow limb to an associated crossbow, the crossbow limb pocket comprising:

an inner limb pocket component that comprises: (1) a support surface that mounts the limb pocket to the crossbow; (2) a bottom wall; and, (3) first and second side walls that extend from the bottom wall; wherein the walls of the inner limb pocket component define a first limb reception channel that receives an end of the associated bow limb;

an outer limb pocket component that comprises: (1) a bottom wall; and, (2) first and second side walls that extend from the bottom wall; wherein the walls of the outer limb pocket component define a second limb reception channel that receives the end of the associated bow limb;

a connector that connects the outer limb pocket component to the inner limb pocket component to hold the end of the associated bow limb within the first and second limb reception channels;

wherein at least a first groove is formed in one of the inner limb pocket component and the outer limb pocket component;

wherein the first groove is formed in one of: (1) one of the first and second side walls of the inner limb component; and, (2) one of the first and second side walls of the outer limb component;

wherein the first groove is defined by a first groove surface that has a first portion, a second portion and a mid-portion that: (1) is positioned between the first and second portions; and, (2) extends inwardly farther than the first and second portions;

wherein at least a first key is formed on the other of the inner limb pocket component and the outer limb pocket component;

wherein the first key is formed on the other of: (1) one of the first and second side walls of the inner limb component; and, (2) one of the first and second side walls of the outer limb component;

wherein the first key is defined by a first key surface that has a first portion, a second portion and a mid-portion that: (1) is positioned between the first and second portions; and, (2) extends outwardly farther than the first and second portions; and, wherein the first key is received within the first groove when the inner limb pocket component is connected to the outer limb pocket component.

12. The crossbow limb pocket of claim 11 wherein when the inner limb pocket component is connected to the outer limb pocket component:

the first portion of the first groove surface contacts the first portion of the first key surface; and, the second portion of the first groove surface contacts the second portion of the first key surface.

13. The crossbow limb pocket of claim 11 wherein when the inner limb pocket component is connected to the outer limb pocket component:

the mid-portion of the first groove surface contacts the mid-portion of the first key surface.

14. The crossbow limb pocket of claim 11 wherein:

the wall that the first groove is formed in has a groove wall thickness and the first groove has a groove length that is substantially the same as the groove wall thickness; and, the wall that the first key is formed on has a key wall thickness and the first key has a key length that is substantially the same as the key wall thickness.

15. The crossbow limb pocket of claim 11 wherein:

the first groove is substantially V-shaped; and, the first key is substantially V-shaped.

16. The crossbow limb pocket of claim 11 wherein:

the first groove has a groove depth;

the first key has a key height that is substantially equal to the groove depth;

the first groove has a groove width; and, the first key has a key width that is substantially equal to the groove width.

17. The crossbow limb pocket of claim 11 wherein:

the first groove has a groove width defined by first and second groove ends;

the mid-portion of the first groove surface is positioned substantially between the first and second groove ends;

the first key has a key width defined by first and second key ends; and, the mid-portion of the first key surface is positioned substantially between the first and second key ends.

18. The crossbow limb pocket of claim 11 wherein:

at least a second groove is formed in one of the inner limb pocket component and the outer limb pocket component;

the second groove is formed in one of: (1) one of the first and second side walls of the inner limb component; and, (2) one of the first and second side walls of the outer limb component;

the second groove is not formed in the same wall that the first groove is formed in;

the second groove is not formed in the same wall that the first key is formed on;

the second groove is defined by a second groove surface that has a first portion, a second portion and a mid-portion that: (1) is positioned between the first and second portions; and, (2) extends inwardly farther than the first and second portions;

at least a second key is formed on the other of the inner limb pocket component and the outer limb pocket component;

the second key is formed on the other of: (1) one of the first and second side walls of the inner limb component; and, (2) one of the first and second side walls of the outer limb component;

the second key is defined by a second key surface that has a first portion, a second portion and a mid-portion that: (1) is positioned between the first and second portions; and, (2) extends outwardly farther than the first and second portions; and, the second key is received within the second groove when the inner limb pocket component is connected to the outer limb pocket component.

19. The crossbow limb pocket of claim 18 wherein:

the inner limb pocket component has a connector opening that receives the connector; and, when the inner limb pocket component is connected to the outer limb pocket component, a line that intersects the mid-portion of the first key surface and the mid-portion of the second key surface does not intersect the connector opening.

20. The crossbow limb pocket of claim 18 wherein:

the associated bow limb has a longitudinal axis; and, when the inner limb pocket component is connected to the outer limb pocket component, a line that intersects the mid-portion of the first key surface and the mid-portion of the second key is substantially perpendicular to the associated bow limb's longitudinal axis.

* * * * *